US005795541A

United States Patent [19]

Tanigawa et al.

[11] Patent Number: 5,795,541

[45] Date of Patent: Aug. 18, 1998

[54] ALUMINUM ALLOY SHEET FOR LITHOGRAPHIC PRINTING PLATES AND METHOD FOR MANUFACTURING THE SAME

[75] Inventors: Masaki Tanigawa, Moka; Shinichiro Hosono, Moko; Kozo Hoshino, Moko; Yoshihiko Asakawa, Kobe, all of Japan

[73] Assignee: Kabushiki Kaisha Kobe Seiko Sho. Kobe, Japan

[21] Appl. No.: 772,572

[22] Filed: Dec. 26, 1996

[30] Foreign Application Priority Data

| | | | |
|---|---|---|---|
| Jan. 5, 1996 | [JP] | Japan | 8-000346 |
| Apr. 8, 1996 | [JP] | Japan | 8-085572 |
| Apr. 8, 1996 | [JP] | Japan | 8-085576 |
| Apr. 11, 1996 | [JP] | Japan | 8-089697 |
| Apr. 16, 1996 | [JP] | Japan | 8-094146 |
| Apr. 17, 1996 | [JP] | Japan | 8-095702 |
| Apr. 17, 1996 | [JP] | Japan | 8-095723 |
| Jul. 17, 1996 | [JP] | Japan | 8-187102 |
| Jul. 18, 1996 | [JP] | Japan | 8-189619 |

[51] Int. Cl.[6] ..... C22C 21/00

[52] U.S. Cl. ..... 420/520; 420/537; 420/538; 420/531; 420/540; 420/548; 420/550; 420/551; 420/552; 148/437

[58] Field of Search ..... 420/537, 538, 420/531, 540, 548, 550, 551, 552; 148/437

[56] References Cited

U.S. PATENT DOCUMENTS

| | | | |
|---|---|---|---|
| 4,634,656 | 1/1987 | Ohashi et al. | 430/278 |
| 4,729,939 | 3/1988 | Nishikawa et al. | 430/278 |
| 5,110,371 | 5/1992 | Moriyama et al. | 148/691 |
| 5,336,341 | 8/1994 | Maejima et al. | 148/415 |

FOREIGN PATENT DOCUMENTS

| | | |
|---|---|---|
| 58-210144 | 12/1983 | Japan . |
| 62-230946 | 10/1987 | Japan . |
| 63-30294 | 2/1988 | Japan . |
| 3-122241 | 5/1991 | Japan . |
| 3-177528 | 8/1991 | Japan . |
| 3-177529 | 8/1991 | Japan . |
| 4-325644 | 11/1992 | Japan . |

*Primary Examiner*—David A. Simmons
*Assistant Examiner*—M. Alexandra Elve
*Attorney, Agent, or Firm*—Oblon, Spivak, McClelland, Maier & Neustadt, P. C.

[57] ABSTRACT

An aluminum alloy sheet for printing plate contains Fe: 0.2 to 0.6 Wt %, Si: 0.03 to 0.15 Wt %, Ti: 0.005 to 0.05 Wt %, Ni: 0.005 to 0.20 Wt %, and remainder of Al and inevitable impurity, wherein a ratio of Ni content and Si content satisfies $0.1 \leqq Ni/Si \leqq 3.7$. The aluminum alloy sheet is manufactured by homogenizing an aluminum alloy ingot at a temperature in a range of 500° to 630° C., after performing hot rolling at start temperature in a range of 400° to 450° C., providing cold rolling and intermediate annealing, and further performing final cold rolling. By this, the aluminum alloy sheet for printing plate is prevented from pit generation upon dipping in electrolytic solution in a condition where an electric power is not applied. Uniformity of grained surface of the aluminum alloy sheet by electrolytic treatment can be improved.

27 Claims, 3 Drawing Sheets

ALUMINUM ALLOY SHEET FOR LITHOGRAPHIC PRINTING PLATES AND METHOD FOR MANUFACTURING THE SAME

BACKGROUND OF THE INVENTION

1. Field of the Invention

The present invention relates to an aluminum alloy sheet for a printing plate to be used as support body of a printing plate in a lithographic printing.

2. Description of the Related Art

In lithographic printing, aluminum plate or aluminum alloy sheet (hereinafter the word "aluminum alloy" may be used in a meaning including aluminum plate) has been typically used as support body. In view of adhesion of a photosensitive layer and water retaining property in a non-imaged portion, graining of the surface of the support body is required.

Conventionally, as a graining treatment method of the surface of the support body, a mechanical treatment method, such as a ball grinding method, brush grinding method and so forth have been used. In the recent years, an electrolytic graining treatment method, in which the surface of the aluminum plate is electrochemically grained using hydrochloric acid or an electrolytic solution containing hydrochloric acid as primary component or an electrolytic solution containing nitric acid as primary component, or combination of the foregoing mechanical treatment method and the electrolytic treatment method are primarily employed, in the recent years. This is because that the grained surface plate obtained through the electrolytic surface graining treatment method is suitable for plate making and demonstrates superior printing performance. Furthermore, the electrolytic surf ace graining treatment method is well suited with continuous treatment by forming the aluminum alloy sheet in a coil shape.

As set forth above, in the aluminum alloy sheet with grained surface, it is been required to provide uniform unevenness by graining treatment. In the aluminum alloy sheet for printing plate, formed with uniform unevenness, adhesion to the photosensitive layer and water retaining property can be improved, and in conjunction therewith, superior image distinction and printing wear can be obtained. In the recent years, in order to lower a cost for graining treatment, it has been strongly demanded a material which can form uniform unevenness at shorter treatment period and lower power consumption.

For example, there has been proposed an aluminum alloy sheet having superior uniformity of surface grain, containing Fe: 0.2 to 1.0 Wt %, at least one element selected among a group consisted of Sn, In, Ga and Zn in the content of 0.05 to 0.1 Wt %, and further containing Cu: 0.1 to 2 Wt % (Japanese Unexamined Patent Publication (Kokai) No. Showa 58-210144). The proposed aluminum alloy sheet achieves superior rate of dissolution in chemical etching treatment, and improves uniformity of unevenness by forming an intermetallic compound promoting formation of uniform pits.

Also, as an aluminum alloy sheet with improved surface grain uniformity, there has been proposed an aluminum plate composed of Fe: 0.1 to 0.5 Wt %, Si: 0.03 to 0.30 Wt %, Cu: 0.001 to 0.03 Wt %, Ni: 0.001 to 0.03 Wt %, Ti: 0.002 to 0.005 Wt %, Ga: 0.005 to 0.002 Wt %, and total content of Ga and Ti is in a range of 0.010 to 0.050 Wt % (Japanese Unexamined Patent Publication No. Heisei 3-177528).

However, in conventional aluminum alloy sheets having a uniform surface grain, none of the proposed aluminum alloy sheets has actually been examined for the possibility of the formation of giant pits under certain treatment conditions. In actual practice, electrolytic treatment of the conventional aluminum alloy sheets, when the aluminum alloy sheet is dipped in the electrolytic solution without applying electric power for a period of time, chemical etching enlarges the pits. Therefore, when the aluminum alloy sheet is subject to electrolytic treatment, the surface grain becomes non-uniform.

SUMMARY OF THE INVENTION

It is therefore an object of the present invention to provide an aluminum alloy sheet for printing plate and a method for manufacturing the same, in which when an electrolytic treatment is to be performed, occurrence of pit upon dipping in an electrolytic solution without applying an electric power can be restricted and thus, uniformity of surface grain resulting from electrolytic treatment can be improved.

An aluminum alloy sheet for printing plate, according to the present invention, containing:

Fe: 0.2 to 0.6 Wt %;

Si: 0.03 to 0.15 Wt %;

Ti: 0.005 to 0.05 Wt %;

Ni: 0.005 to 0.20 Wt %; and remainder of Al and inevitable impurity, wherein a ratio of Ni content and Si content satisfies $0.1 \leqq Ni/Si \leqq 3.7$.

A manufacturing method of an aluminum alloy sheet for printing plate, according to the present invention, comprising the steps:

homogenizing an aluminum alloy ingot, which consists essentially of Fe: 0.2 to 0.6 Wt %, Si: 0.03 to 0.15 Wt %, Ti: 0.005 to 0.05 Wt %, Ni: 0.005 to 0.20 Wt %, and balance: Al and inevitable impurities, a ratio of Ni content and Si content satisfying $0.1 \leqq Ni/Si \leqq 3.7$, at a temperature in a range of 500° to 630° C.;

hot rolling said aluminum ingot at start temperature in a range of 400° to 450° C.;

cold rolling said hot-rolled aluminum sheet;

intermediate annealing said cold-rolled sheet; and final cold rolling said annealed sheet.

According to the present invention, the aluminum alloy sheet has a predetermined composition. Also, by manufacturing the aluminum alloy sheet under the predetermined heat treatment condition, when electrolytic surface graining treatment is performed, dipping of the aluminum alloy sheet in the electrolytic solution under the condition where the power is not applied before and during treatment to form uniform pit. Thus, the aluminum alloy sheet for printing plate with good grained surface can be obtained.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENTS

Figure 1:
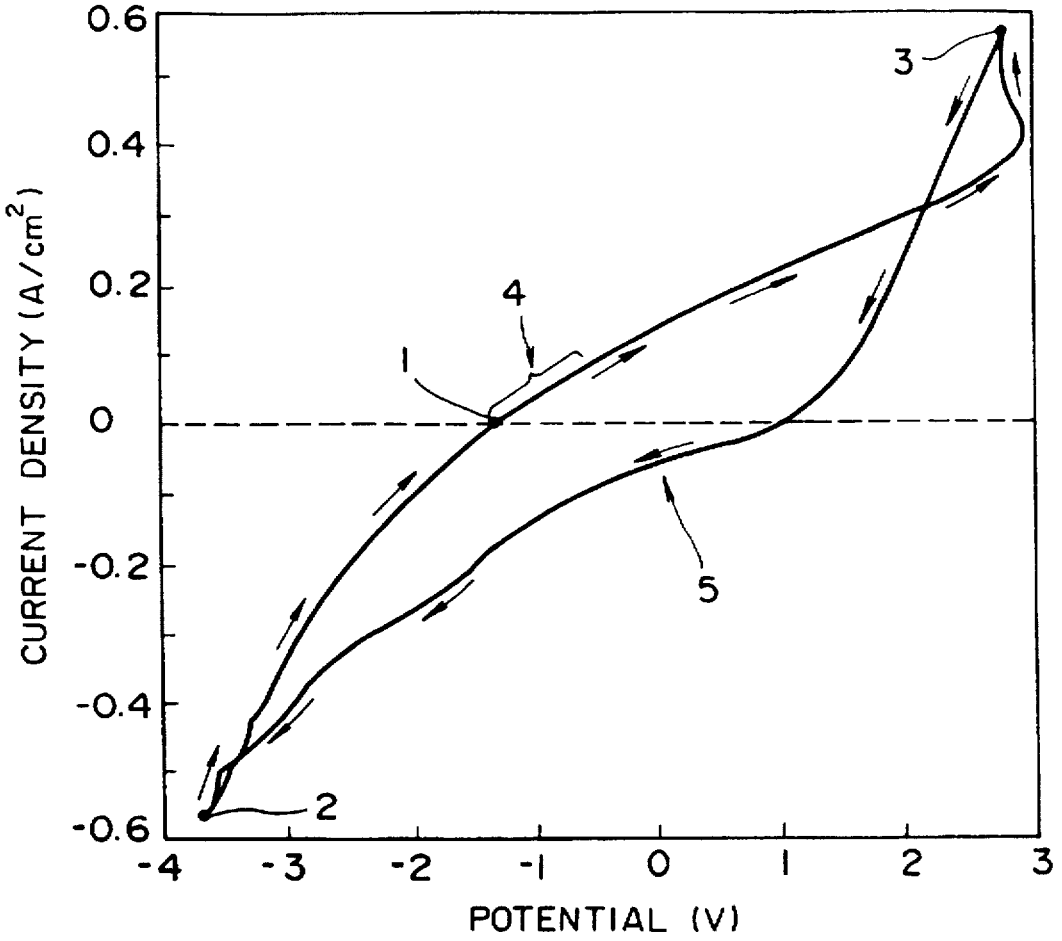
FIG. 1 is a graph showing a relationship between a current density and potential.

The inventors have made various experiments and study for developing an aluminum alloy sheet for printing plate and a manufacturing method therefor in which when an electrolytic treatment is to be performed, occurrence of pit upon dipping in an electrolytic solution without applying an electric power can be restricted and thus, uniformity of surface grain resulting from electrolytic treatment can be improved.

As a result, the inventors have found that chemical-etch ability of an aluminum alloy sheet can be improved and, as a result, uniformity of surface grain can be improved, by adding Ni and Zn in aluminum. However, since Ni and Zn has high chemical-etch ability, under a treatment condition to be employed in actual treatment line, more concretely, in the case where aluminum alloy sheet is dipped in an electrolytic solution without application of an electric power before electrolytic treatment or during electrolytic treatment, local pit should be caused on the surface of the aluminum alloy sheet due to chemical dissolution. It is further found that occurrence of local pit can be a cause of local giant pit formed through electrolysis. Accordingly, simple addition of Ni and Zn to the aluminum alloy sheet may not improve uniformity of surface grain under all possible treatment condition. Therefore, some measure for controlling chemical-etch ability of the aluminum alloy sheet within an appropriate range has to be taken.

Therefore, extensive study has been made by the inventors for a method for controlling chemical-etch ability of the aluminum alloy sheet within an appropriate range. As a result, it becomes clear that, concerning the aluminum alloy sheet, to which Zn is added, it is difficult to control chemical-etch ability. However, concerning the aluminum alloy added Ni, it has been found that chemical-etch ability can be controlled within an appropriate range and improvement of uniformity if surface grain can be achieved even under the condition where the aluminum alloy sheet is dipped in the electrolytic solution without application of electric power, by controlling additive amount of Ni and controlling ratio of components of the alloy. The present invention has been made on the basis of such finding.

Reason of addition of the components and reason of limitation of the contents of the components in the aluminum alloy sheet for a printing plate according to the present invention will be discussed hereinafter together with manufacturing condition in a manufacturing treatment of the aluminum alloy sheet.

Fe (iron): 0.2 to 0.6 Wt %

Fe acts for formation of uniform pit in electrolytically grained surface. Fe is an element to form an Al-Fe type intermetallic compound by coupling with other elements in the aluminum alloy. This eutectic compound serves for formation of fine re-crystallized grain, and improves mechanical strength by unifying structure. Also, the Al-Fe type intermetallic compound has a function as starting point of initial pit in electrolytic surface graining treatment. When content of Fe is less than 0.2 Wt %, amount of Al-Fe type intermetallic compound presenting in the aluminum alloy sheet becomes too small. This results in insufficient formation of the initial pit at electrolytic surface graining treatment. On the other hand, when the content of Fe exceeds 0.6 Wt %, large grain size compound may be formed to make the electrolytically grained surface to have un-uniform grain. Accordingly, the additive amount should be in a range of 0.2 to 0.6 Wt %, and preferably in a range of 0.25 to 0.6 Wt %.

Si (silicon): 0.03 to 0.15 Wt %

Si is an element to serve for restricting chemical-etch ability of the material in the aluminum alloy. Therefore, By addition in combination with Ni, the chemical-etch ability of the aluminum alloy can be controlled within an appropriate range. Also, Si forms Al-Fe-Si type intermetallic compound to serve as core in recrystallization between each pass in hot rolling, and thus serves for formation of fine recrystallized grain during hot rolling. When the additive amount of Si is less than 0.03 Wt %, control of chemical-etch ability becomes insufficient and cannot restrict formation of pit of the aluminum alloy sheet under the condition dipped in the electrolytic solution without application of electric power.

On the other hand, when Si is added in excess of 0.15 Wt %, chemical-etch ability is excessively restricted to make formation of graining pit of the aluminum alloy sheet by electrolytic surface graining treatment insufficient to make it difficult to obtain uniformly grained surface. Also, excessive additive amount of Si may create large grain size compound to make electrolytically grained surface un-uniform. Accordingly, the additive amount of Si should be 0.03 to 0.15 Wt %.

Ti (titanium): 0.005 to 0.05 Wt %, Preferably more than or equal to 0.01 Wt %

Addition of Ti or base alloy of Ti-B is effective for obtaining fine cast structure and for obtaining fine crystal grain. When Ti content is less than 0.005 Wt %, refining effect cannot be obtained. On the other hand, in addition to effect for making structure and grain fine, Ti is also effective for making the electrolytically grained surface uniform similarly to the foregoing other components. It is preferred that the content of the Ti is greater than or equal to 0.01 Wt %. On the other hand, when additive amount of Ti exceeds 0.05 Wt %, effect for making structure and/or grain saturates. Therefore, further addition of Ti is wasting.. Furthermore, excessive additive amount of Ti should make it easier to cause un-uniform pits in electrolytic surface graining treatment. Furthermore, by formation of large grain size compound, un-uniform electrolytically grained surface may be formed. Accordingly, additive amount of Ti is 0.005 to 0.05 Wt %, preferably more than or equal to 0.01 Wt %.

Ni (nickel): 0.005 to 0.20 Wt %

Ni is effective in unifying electrolytically grained surface. Namely, Ni is an element which may improve chemical-etch ability of aluminum alloy and may improve graining ability upon electrolytic surface graining treatment. Also, Ni forms Al-Fe-Ni type intermetallic compound. This compound has higher potential than the Al-Fe type compound, it may further promote formation of initial pit by electrolytic surface graining treatment to make it possible to obtain uniform grained surface in shorter period. Thus, addition of Ni enables to form uniform grained surface in shorter period. If the Ni content is less than 0.005 Wt %, improvement of chemical-etch ability becomes insufficient, and in addition, initial pit forming performance also becomes insufficient. Therefore, it becomes impossible to improve surface graining efficiency to leave non-grained portion. On the other hand, when exceeding 0.20 Wt % of Ni is added, chemical-etch ability becomes excessive to promote formation of pit of the aluminum alloy sheet under dipping condition in the electrolytic solution without applying electric power to cause degradation of uniformity of grained surface pits. Namely, large grain size compound can be formed to make the electrolytically grained surface un-uniform. Therefore, the additive amount of Ni is in a range of 0.005 to 0.20 Wtl %.

$0.1 \leqq Ni/Si \leqq 3.7$

In order to improve uniformity of grained surface of the aluminum alloy sheet, it is necessary that the ratio of Ni content and Si content falls within the above-identified range. This is because the improved chemical-etch ability by addition of Ni is controlled by chemical-etch ability restricting function of Si as set forth above, uniformity of the grained surface can be improved, and, in conjunction therewith, it becomes possible to obtain aluminum alloy sheet having proper chemical-etch ability capable of suppression of formation of pits in dipping condition in the electrolytic solution without applying electric power. However, when the value of Ni/Si is greater than 3.7, restriction of chemical-etch ability becomes insufficient to make it impossible to restrict formation of pit during dipping condition in the electrolytic solution without applying electric power. On the other hand, when the value of Ni/Si is smaller than 0.1, restriction of chemical-etch ability becomes excessive, etching amount in electrolytic graining treatment becomes insufficient to make it impossible to obtain uniform grained surface.

B (boron): 1 to 50 Wt p.p.m.

As set forth above, the base alloy of Ti-B serves as agent for making crystal grain size fine. The effect to making crystal grain size fine is achieved by increasing fine core according to increasing of Ti-B particle. The inventors have found that, in addition to the effect as set forth above, increasing of number of Ti-B particle is effective in unifying electrolytically grained surface.

When B content is less than 1 Wt p.p.m., etching pits tends to be un-uniform. On the other hand, when B content exceeds 50 Wt p.p.m. large grain size compound may be formed. This large grain size compound may form groove form deep pits to make the electrolytically grained surface un-uniform. Accordingly, when B is contained in the aluminum alloy, the content should be 1 to 50 Wt p.p.m.

In addition to the foregoing additive elements set forth above, it is permitted to contain a predetermined amount of Mg, Mn, Cr, Zr, In, Sn, Pb, Ga, and V as impurity. Mg and Ga may be contained in 0.05 Wt % at the maximum, Mn, Cr and Zr may be contained in 0.03 Wt % at the maximum, In, Sn, Pb and V may be contained in 0.02 Wt % at the maximum. Then, presence of these impurity in the amount less than or equal to the maximum content, may be permitted.

One or More Elements Selected from a Group Consisted of Cu (copper) and Zn: 0.005 to 0.05 Wt % per Element Cu presents in the aluminum alloy in dissolved condition, adjusts potential difference between aluminum matrix and the intermetallic compound, and is effective for unifying electrolytically grained surface. When the content of Cu is less than 0.005 Wt %, potential adjusting effect becomes insufficient to cause un-uniformity on the electrolytically grained surface. On the other hand, when Cu content exceeds 0.05 Wt %, non-grained portion may be formed on the surface of the aluminum alloy sheet.

On the other hand, Zn tends to present in the aluminum alloy in dissolved condition similarly to Cu, adjusts potential difference between aluminum matrix and the intermetallic compound, and is effective for unifying electrolytically grained surface. When Zn content is less than 0.005 Wt %, the potential adjusting effect cannot be obtained to cause non-grained portion. On the other hand, when Zn content exceeds 0.05 Wt %, surface dissolving with smooth surface can be caused to form un-uniform electrolytically grained surface.

Accordingly, the content of the one or more elements selected among a group consisted of Cu and Zn is 0.005 to 0.05 Wt %.

Intermetallic Compound: 0.5 to 2.0 Wt %

The intermetallic compound serves an initiation point of an initial pit in electrolytic surface graining treatment, and provides important effects in improvement of the uniformity of the grained surface. When the content of the intermetallic compound is too small, formation of the initial pit becomes insufficient and etching may not be propagated over the entire surface to cause non-grained portion. On the other hand, when excess amount is contained, uniformity of the grained surface may be degraded. For the reason set forth above, it is quite important to appropriately control within a given appropriate range the content of the intermetallic compound. When the contents is less than 0.005 Wt %, formation of the initial pits becomes insufficient. On the other hand, when the content of the intermetallic compound exceeds 2.0 Wt %, the large pit tends to be formed to degrade uniformity of the grained surface. Therefore, the content of the intermetallic compound is 0.5 to 2.0 Wt %.

Next, the reason of limitation of the composition of the intermetallic compound in the aluminum alloy sheet will be discussed.

Fe in Intermetallic Compound: 20 to 30 Wt %

When Fe content in the intermetallic compound is less than 20 Wt %, improvement of graining ability is insufficient to cause non-grained portion. On the other hand, if Fe content in the intermetallic compound exceeds 30 Wt %, uniformity of the electrolytically grained surface can be degraded. Accordingly, Fe content in the intermetallic compound is in a range of 20 to 30 Wt %.

Si in Intermetallic Compound: 0.3 to 0.8 Wt %

If Si content in the intermetallic compound is less than 0.3 Wt %, improvement of graining ability is insufficient to cause non-grained portion, similarly to Fe. On the other hand, if Si content in the intermetallic compound exceeds 0.8 Wt %, uniformity of the electrolytically grained surface can be degraded. Accordingly, Si content in the intermetallic compound is in a range of 0.3 to 0.8 Wt %.

Ni in Intermetallic Compound: 0.3 to 10 Wt %

If Ni content in the intermetallic compound is less than 0.3 Wt %, improvement of graining ability is insufficient to cause non-grained portion, similarly to Fe and Si. On the other hand, if Ni content in the intermetallic compound exceeds 10 Wt %, uniformity of the electrolytically grained surface can be degraded. Accordingly, Ni content in the intermetallic compound is in a range of 0.3 to 10 Wt %.

It should be noted that the reason why the graining ability cannot be improved when the content of Fe, Si and Ni in the intermetallic compound is smaller than the range defined by the present invention, is that an electrochemical potential difference between the intermetallic compound and aluminum matrix is not sufficient to promote dissolving of matrix. On the other hand, the reason why degradation of uniformity of the electrolytically grained surface is cased when the content of Fe, Si and Ni in the intermetallic compound is greater than the range defined by the present invention, is that the potential difference between the intermetallic compound and the matrix becomes excessive to cause significant difference of solubility between the matrix in the vicinity of the intermetallic compound and other matrix. It should be appreciated that the reason why the graining ability cannot be improved and why the uniformity of the electrolytically grained surface is degraded are not limited to the reasons set forth above, and other factors are considered to be associated therewith.

While impurity, such as Ti and so forth can be admixed in the intermetallic compound in the order of p.p.m., such impurity may not affect the effect of the present invention.

Next, discussion will be given for the reason of limitation of composition of aluminum matrix of the aluminum alloy sheet. The composition of aluminum matrix represents dissolved components of aluminum, and does not include the components separated out from the aluminum, such as the intermetallic compound and so forth.

Fe in Aluminum Matrix: 0.01 to 0.20 Wt %

When Fe content in aluminum matrix is less than 0.01 Wt %, uniformity of the electrolytically grained surface can be degraded. On the other hand, when Fe content in aluminum matrix exceeds 0.20 Wt %, graining ability cannot be improved and non-grained portion may be remained on the electrolytically grained surface. Therefore, Fe content in aluminum matrix is in a range of 0.01 to 0.20 Wt %.

Si in Aluminum Matrix: 0.02 to 0.10 Wt %

When Si content in aluminum matrix is less than 0.02 Wt %, uniformity of the electrolytically grained surface can be degraded, similarly to the case where Fe content is too small. On the other hand, when Si content in aluminum matrix exceeds 0.10 Wt %, graining ability cannot be improved and non-grained portion may be remained on the electrolytically grained surface. Therefore, Si content in aluminum matrix is in a range of 0.02 to 0.10 Wt %.

Ni in Aluminum Matrix: 0.0005 to 0.02 Wt %

When Ni content in aluminum matrix is less than 0.0005 Wt %, uniformity of the electrolytically grained surface can be degraded, similarly to the case where Fe or Si content is too small. On the other hand, when Ni content in aluminum matrix exceeds 0.02 Wt %, graining ability cannot be improved and non-grained portion may be remained on the electrolytically grained surface. Therefore, Ni content in aluminum matrix is in a range of 0.0005 to 0.02 Wt %.

As set forth above, the followings are considered to be reasons why the graining ability cannot be improved and why uniformity of the electrolytically grained surface is degraded when Fe, Si and Ni contents in aluminum matrix is out of the range defined by the present invention. When the Fe, Si and Ni content in the aluminum matrix is too small than that defined in the present invention, the potential difference between the intermetallic compound and the aluminum matrix becomes too large to cause difference is solubility between the aluminum matrix in the vicinity of the intermetallic compound and other aluminum matrix to cause degradation of uniformity of the grained surface.

On the other hand, when Fe, Si and Ni contents in the aluminum matrix is too large beyond the range defined by the present invention, the potential difference between the intermetallic compound and the aluminum matrix too small to promote dissolving of the matrix, and thus graining ability cannot be improved.

Next, discussion will be given with respect to Si content in a surface portion of the aluminum alloy sheet for printing plate from the surface to 3 μm.

Si in Surface Portion of Aluminum Alloy Sheet for Printing Plate: 0.05 to 0.2 Wt %

By concentrating Si in the surface portion of the aluminum alloy sheet, the electrolytically grained surface can be further unified. When the Si content in the surface portion from the surface to the 3 μm depth is less than 0.05 Wt %, surface enrichment lacks to cause degradation of uniformity of the electrolytically grained surface. On the other hand, when the Si content in the surface portion exceeds 0.2 Wt %, un-uniform grained surface may be formed by excessive etching. Accordingly, the Si content in the surface portion from the outermost surface to 3 μm depth is in a range of 0.05 to 0.2 Wt %.

Next, discussion will be given for a reason of numerical limitation of polarization resistor upon electrolytic surface graining treatment.

Polarization Resistance: 4 to 17 $\Omega cm^2$

As set forth above, the polarization resistance in each cycle should significantly affect for occurrence ratio of non-grained portion and uniformity in size of the pits. When elements, such as Fe, Si and Ni to be contained in the aluminum alloy sheet, is present in the intermetallic compound, the potential difference between the intermetallic compound and the aluminum matrix becomes large to make polarization resistance smaller to improve graining ability. Therefore, non-grained portion will never be caused and whereby uniform pits can be formed. When the polarization resistance becomes too small, dissolving is excessively promoted to easily cause dissolving with Smooth surface. Accordingly, in addition to the foregoing chemical composition as set forth above, the polarization resistance has to be an appropriate value.

When the polarization resistance is lower than 4 $\Omega cm^2$, dissolving with Smooth surface is easily caused to degrade uniformity of the electrolytically grained surface. On the other hand, when the polarization resistance exceeds 17 $\Omega cm^2$, graining ability becomes too low and thus non-grained portion can be increased. Accordingly, the polarized resistance has to be within a range of 4 to 17 $\Omega cm^2$.

It should be noted that, in the normal case, the electrolytic surface graining treatment is performed for several thousands cycles, the polarization resistance for all cycles is to be 4 to 17 $\Omega cm^2$.

Hereinafter, discussion will be given for definition of the polarization resistance. FIG. 1 is a graph showing a relationship between the potential (V) represented by horizontal axis and a current density ($A/cm^2$) represented by vertical axis, and showing one cycle (potential-current curve) in the electrolytic surface graining treatment. In FIG. 1, the potential is the potential when the potential a saturated Calomel electrode (SCE) is taken as 0V. As shown by arrow in FIG. 1, according to elapsing of time, the potential is lowered from maximum anode potential 3 to maximum cathode potential 2, and subsequently risen to the maximum anode potential 3. Such cycle is repeated for a plurality of times. In one cycle, the potential becomes 0V twice. Among these zero-crossing voltage, one upon rising of the potential is the potential 1 upon anode reaction starting. Among the cycle 5, the portion above the potential 1 is an anode reaction initial period 4. A value derived by dividing the gradient namely potential, at the anode reaction initial period 4 by the current density is defined as the polarization resistance. In this case, the concrete length of the anode reaction initial period 4 is not specifically defined. However, when a frequency for electrolytic surface graining treatment is 50 Hz, the anode reaction initial period 4 may be a range of about 1 msec. from anode reaction start point in each cycle, for example.

It should be noted that if the anode reaction initial period is uncertain, such as when the frequency to be employed in the electrolytic surface graining treatment is different, the anode reaction initial period is defined as 1/20 of one cycle from the anode reaction starting point. Also, one cycle shown in FIG. 1 is merely one example, and cycle should not be limited to that illustrated.

Next, discussion will be given for a measuring method of a resistance of skin layer formed on the surface of the aluminum alloy sheet and reason of limitation.

Maximum Value of Real Number Axis Component in Impedance trace Developed on Gauss-Argand Plane: 100 to 1000 (Ω)

As means for seizing on phenomenon caused on the surface of metal, there is an interface impedance. In the present invention, by measuring the interface impedance, a resistance value of the skin layer formed on the surface of the aluminum alloy sheet is derived. The interface impedance can be graphically expressed by an impedance trace, namely a vector trace of impedance Z(jω) with taking an angular frequency (ω) as parameter. Therefore, on Gauss-Argand plane, when coordinates is divided into real number axis component R and imaginary number axis component X, the impedance Z can be expressed by the following equation:

$$Z(j\omega)=R(107)+jX(\omega) \quad (1)$$

wherein ω: angular frequency

Figure 2:
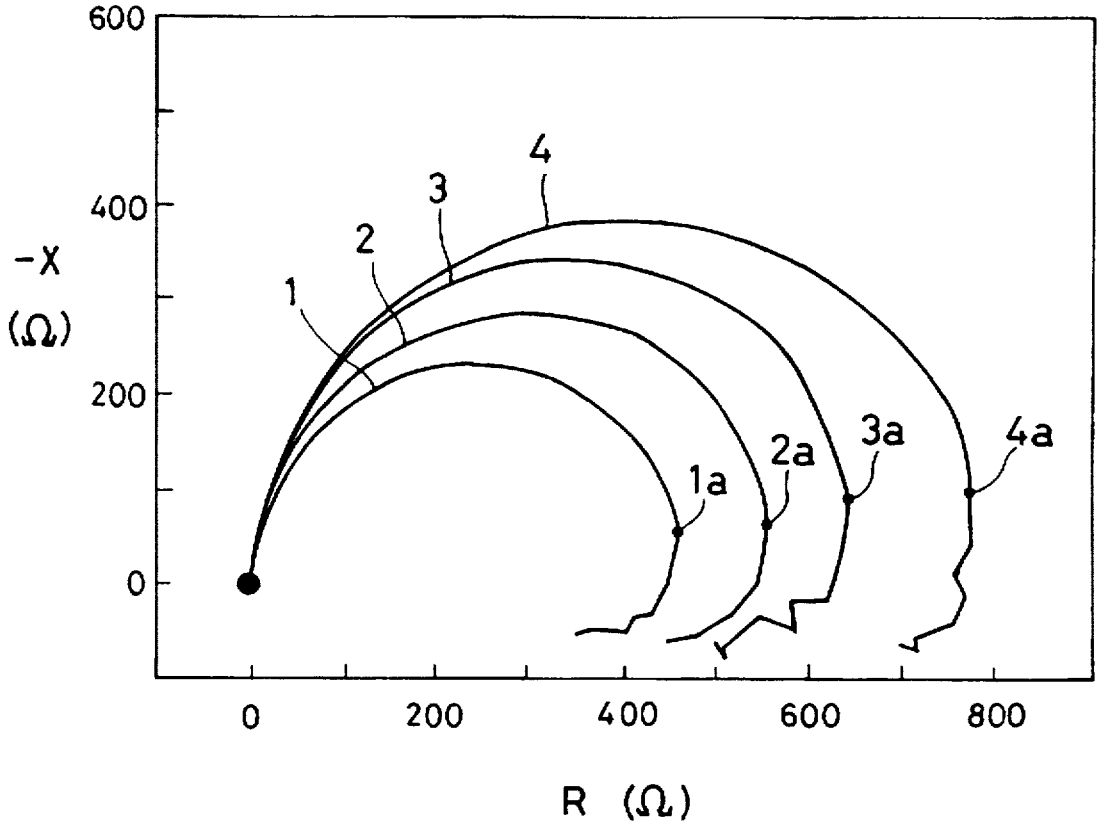
FIG. 2 is a graph showing a relationship between -X and R.

FIG. 2 is a graph showing an example of impedance traces of four kinds of printing plate with taking imaginary number axis components X at vertical axis and real number axis components R at horizontal axis. In general, in the impedance trace, when a circle adjacent to the trace is drawn, smaller real number axis segment of the adjacent circle can be taken as a liquid resistance and greater real number axis segment can be taken as a sum of the liquid resistance and a surface resistance. Therefore, by calculating a different therebetween, the surface resistance can be obtained. Also, an absolute value of the impedance Z can be expressed by the following equation:

$$|Z|=\{R^2(\omega)+X^2(\omega)\}^{1/2} \quad (2)$$

As shown in FIG. 1, the impedance traces 1, 2, 3 and 4 of the printing plate are substantially semi-circle and can be regarded as adjacent circles. Therefore, in the present invention, the values (maximum value) at the points 1*a*, 2*a*, 3*a* and 4*a* where the real number axis components become maximum are taken as the surface resistance. It should be noted that the impedance traces 1, 2, 3 and 4 are examples of impedance traces of the printing plates obtained according to embodiments Nos. 1, 4, 3 and 6 discussed later, respectively.

When the surface resistance of the aluminum alloy sheet is lower than or equal to a predetermined range, namely the maximum value of the real number axis component of the impedance trace is less than 100Ω, dissolving with Smooth surface is easily caused and thus uniform pits cannot be formed. Therefore, uniformity of grained surface is lowered. On the other hand when the surface resistance of the aluminum alloy sheet exceeds the predetermined range, namely when the maximum value of the real number axis component of the impedance trace exceeds 1000Ω, graining ability becomes too low and non-grained portion is increased to lower uniformity of the grained surface. Accordingly, the maximum value of the real number component in the impedance trace developed on Gauss-Argand plane or Gaussian plane is 100 to 1000Ω.

Next, a measuring method of a hydration degree of the skin layer formed on the surface of the aluminum alloy sheet during electrolytic treatment and reason of limitation will be discussed.

Peak Width at Half Height of Binding energy Distribution in a Region Between 530 to 536 eV.

Measuring a binding energy distribution in a region from the surface of the aluminum alloy sheet to 0.5 μm depth by X-ray photoelectron spectroscopy, a peak of $Al_2O_3$ is appears at a position of 531.2±0.4 (eV), and a peak of $Al(OH)_3$ appears at a position of 531.5 (eV). Normally, while both peaks are overlapping for narrow distance, when hydroxide is increased, width of the peak is widened. Accordingly, in the present invention, amount of hydroxide, namely hydration degree of the skin layer formed on the surface of the aluminum alloy sheet during electrolytic treatment, is evaluated by peak width at half height of the binding energy distribution between 530 to 536 eV.

It should be noted that, in the present invention, the peak width at half height of the binding energy distribution in the region from the surface (0 μm) of the aluminum alloy sheet to 0.5 μm, is defined. Therefore, the by setting the measuring region in 0 to 0.5 μm, hydration degree of the skin layer can be certainly analyzed even when fluctuation is caused in the thickness of oxide skin layer.

When the hydration degree of the skin layer is low, namely when the peak width at half height is less than 2 eV, withstanding voltage of the skin layer becomes low to easily cause breakage and thus to easily cause dissolving with Smooth surface. Therefore, uniform pit cannot be formed. Thus, uniform grained surface cannot be formed. On the other hand, when the hydration degree of the skin layer is high, namely when the peak width at half height exceeds 5 eV, the break-dowon voltage of the skin layer becomes large. Then, a portion where the skin layer is not broken and pit is not generated, can be created. Thus, graining ability can be lowered to increase non-grained portion to make it impossible to form uniform grained surface. Accordingly, between 530 to 536 eV, peak width at half height of the binding energy distribution in the region from the surface of the aluminum alloy sheet to 5 μm depth is in a range of 2 to 5 eV.

Next, discussion will be given for reason of limitation of homogenizing treatment temperature and hot rolling starting temperature in the manufacturing treatment of the aluminum alloy sheet.

Homogenizing Treatment Temperature: 500° to 630° C.

When aluminum alloy sheet is manufactured by rolling or so forth from aluminum alloy ingot, it becomes necessary to perform homogenizing treatment at a predetermined temperature before rolling. When the temperature is lower than 500° C., sufficient homogenization cannot be achieved to make the electrolytically grained surface of the aluminum alloy sheet un-uniform. On the other hand, when homogenization treatment is performed at a temperature higher than 630° C., dissolving amount of the alloy ingot becomes too large to make the start points of initial pit during the electrolytic surface graining treatment smaller. Thus, uniform grained surface cannot be obtained. Accordingly, the temperature in homogenization is in a range of 500° to 630° C.

Hot Rolling Start Temperature: 400° to 450° C.

After homogenization treatment as set forth above, when hot rolling is to be performed, it becomes necessary to start rolling at the predetermined temperature. When the start temperature is lower than 400° C., dynamic re-crystallization of rolling becomes insufficient to make crystal structure of the rolled plate un-uniform. Thus, the electrolytically grained surface of the aluminum alloy sheet becomes un-uniform. When the hot rolling start temperature becomes higher than 450° C., crystal grain is excessively grown during hot pass to cause streak. Therefore, when the start temperature of hot rolling falls out of the above-defined range, uniformity of the grained surface can be degraded. Accordingly, the start temperature of hot rolling is 400° to 450°. It should be noted that when rolling treatment is performed, it is possible to perform rolling by cooling to the range of the foregoing hot rolling start temperature after homogenization treatment. It is also possible to perform hot rolling by re-heating the aluminum alloy ingot lowered the temperature after completion of the homogenization treatment.

On the other hand, in order to enhance flatness of the aluminum alloy sheet in final cold rolling, it is desirable to perform lever correction.

Hereinafter, examples of the present invention, will be discussed in comparison with comparative example falling out of the scope of claims.

Embodiment A

At first, an aluminum alloy ingot having chemical composition shown in the following Table A-1 was faced to make a thickness of 470 mm. Then, the aluminum alloy ingot was subject homogenization treatment at 590° C. for four hours. Subsequently, hot rolling treatment is performed at 430° C. of rolling start temperature. Thereafter, cold rolling is performed. Then, after performing intermediate annealing, further cold rolling was performed to produce aluminum alloy sheet of 0.3 mm thickness. It should be noted that, in the following Table A-1, the values out of claimed range are shown with underline.

TABLE A-1

| | CHEMICAL COMPOSITION (Wt %) | | | | |
|---|---|---|---|---|---|
| No | Si | Fe | Ti | Ni | Ni/Si |
| EXAMPLE | | | | | |
| A1 | 0.03 | 0.30 | 0.01 | 0.045 | 1.50 |
| A2 | 0.03 | 0.30 | 0.01 | 0.100 | 3.33 |
| A3 | 0.10 | 0.31 | 0.02 | 0.020 | 0.20 |
| A4 | 0.05 | 0.55 | 0.04 | 0.033 | 0.66 |
| A5 | 0.05 | 0.25 | 0.03 | 0.052 | 1.04 |
| A6 | 0.03 | 0.25 | 0.01 | 0.010 | 0.33 |
| COMPARATIVE EXAMPLE | | | | | |
| A7 | 0.03 | 0.30 | 0.01 | 0.004 | 0.13 |
| A8 | 0.03 | 0.30 | 0.01 | 0.300 | 10 |
| A9 | 0.20 | 0.30 | 0.01 | 0.05 | 0.25 |
| A10 | 0.01 | 0.32 | 0.003 | 0.05 | 5 |
| A11 | 0.11 | 0.35 | 0.02 | 0.01 | 0.09 |
| A12 | 0.03 | 0.70 | 0.01 | 0.07 | 2.33 |
| A13 | 0.03 | 0.30 | 0.003 | 0.03 | 1.00 |
| A14 | 0.03 | 0.30 | 0.06 | 0.10 | 3.33 |

Next, for respective aluminum alloy sheet produced as set forth above, degreasing and neutralization washing were performed by treatment conditions 1 and 2 shown in the following Table A-2. Thereafter, dipping without applying power was performed. Subsequently, in the electrolytic solution, in which the aluminum alloy sheets were dipped, alternate current electrolytic surface graining treatment was performed. Then, desmutting treatment for removing oxide and so forth formed by electrolytic treatment was performed. After completion of desmutting treatment, respective aluminum alloy sheet were washed and dried. Then, the aluminum alloy sheets were cut into a given size as samples.

TABLE A-2

| TREATMENT | | |
|---|---|---|
| | TREATMENT CONDITION 1 | |
| DEGREASING | SOLUTION | 10% SODIUM HYDROXIDE |
| | TEMPERATURE | 40° C. |
| | TIME | 10 SEC. |
| NEUTRALIZATION WASHING | SOLUTION | 10% NITRIC ACID |
| | TEMPERATURE | 20° C. |
| | TIME | 30 SEC. |
| DIPPING | SOLUTION | 1.8% HYDROCHLORIC ACID |
| | TEMPERATURE | 25° C. |
| | TIME | 30 SEC. |
| ALTERNATE CURRENT ELECTROLYTIC SURFACE ROUGHENING TREATMENT | FREQUENCY | 50 Hz |
| | CURRENT DENSITY | 60 A/dm$^2$ |
| | TIME | 30 SEC. |
| DESMUTTING TREATMENT | SOLUTION | 5% SODIUM HYDROXIDE |
| | TEMPERATURE | 60° C. |
| | TIME | 10 SEC. |
| | TREATMENT CONDITION 2 | |
| DEGREASING | SOLUTION | 10% SODIUM HYDROXIDE |
| | TEMPERATURE | 50° C. |
| | TIME | 30 SEC. |
| NEUTRALIZATION WASHING | SOLUTION | 20% NITRIC ACID |
| | TEMPERATURE | 25° C. |
| | TIME | 30 SEC. |
| DIPPING | SOLUTION | 1.0% NITRIC ACID |
| | TEMPERATURE | 25° C. |
| | TIME | 30 SEC. |
| ALTERNATE CURRENT ELECTROLYTIC SURFACE ROUGHENING TREATMENT | FREQUENCY | 60 Hz |
| | CURRENT DENSITY | 50 A/dm$^2$ |
| | TIME | 15 SEC. |
| DESMUTTING TREATMENT | SOLUTION | 10% SODIUM HYDROXIDE |
| | TEMPERATURE | 40° C. |
| | TIME | 10 SEC. |

Concerning respective samples providing treatments under the conditions shown in the foregoing Table A-2, graining ability and uniformity were evaluated under the following standard.

Evaluation Standard of Graining Ability

The grained surfaces of respective samples were observed by means of scanning electron microscope (SEM) and a photomicrograph is taken so that the total area becomes 0.02 mm$^2$. It should be noted that magnification of the SEM was 350. On the basis of this photomicrograph, areas of the portions where were not grained, were derived. Then, non-grained ratio was derived according to the following equation 1.

$$\text{Non-grained ratio (\%)} = \text{area of non-grained portion/overall area} \times 10 \quad (3)$$

As set forth above, with the non-grained ratio thus derived, graining ability was evaluated. Namely, when the non-grained area being less than or equal to 8.0% is indicated by ○ (good), and being more than 8.0% is indicated by X (no good)

Evaluation Standard of Uniformity

The grained surfaces of respective samples were observed by means of SEM and a photomicrograph is taken at a magnification of 500. On the photomicrograph, total 100 cm of lines are drawn to measure sizes of pits below the lines. At this time, when a difference of sizes of the minimum pit and the maximum pit is less than or equal to 2 μm, uniformity is evaluated as excellent(◎), is 2 to 3 μm, uniformity is evaluated as good (○), and is more than 3 μm, uniformity is evaluated as no good (X).

It should be noted that, in each examples and comparative examples, respective evaluation under the treatment condition 1 and that under the treatment condition 2 are the same.

TABLE A-3

| | No | GRAINING ABILITY EVALUATION | UNIFORMITY EVALUATION |
|---|---|---|---|
| EXAMPLE | A1 | ○ | ○ |
| | A2 | ○ | ○ |
| | A3 | ○ | ○ |
| | A4 | ○ | ○ |
| | A5 | ○ | ○ |
| | A6 | ○ | ○ |
| COMPARATIVE EXAMPLE | A7 | X | X |
| | A8 | ○ | X |
| | A9 | X | X |
| | A10 | ○ | X |
| | A11 | X | X |
| | A12 | ○ | X |
| | A13 | ○ | X |
| | A14 | ○ | X |

As shown in the foregoing Table A-3, concerning the examples A1 to A6, graining ability and uniformity were all goods, and uniform grained surface could be obtained.

On the other hand, the comparative example No. A7 shows the case where additive amount of Ni is smaller than the predetermined amount. In this case, surface graining efficiency was low and graining ability was no good. Furthermore, the pits formed were not uniform.

Comparative example No. A8 shows the case where additive amount of Ni is greater than the predetermined amount and the value of Ni/Si is greater than the predetermined amount. Therefore, chemical-etch ability was excessive. Thus, while graining ability was good, uniformity of the grained surface was no good.

Comparative example No. A9 shows the case where the additive amount of Si is greater than the predetermined amount. Since chemical-etch ability is excessively restricted, both of graining ability and uniformity were no good.

Comparative example No. A10 shows the case where the additive amounts of Si and Ti are smaller than the predetermined amounts, and the value of Ni/Si is greater than the predetermined amount. Therefore, while graining ability was good, uniformity was no good for insufficiency of control of chemical-etch ability.

Comparative example No. All shows the case where the value of Ni/Si is smaller than the predetermined value. Since restriction of chemical-etch ability is excessive, both of graining ability and uniformity were no good.

Comparative example No. A12 shows the case where additive amount of Fe is greater than the predetermined amount. In this case, uniformity was no good.

Comparative examples Nos. A13 and A14 show cases where additive amount of Ti is smaller and greater than the predetermined amount respectively. In these cases, while graining ability was good, uniformity was no good.

Embodiment B

An aluminum alloy ingot having chemical composition shown in the following Table B-1 was faced to make a thickness of 470 mm. Then, the aluminum alloy ingot was subject homogenization treatment at 590° C. for four hours. Subsequently, hot rolling treatment is performed at 430° C. of rolling start temperature. Thereafter, cold rolling is performed. Then, after performing intermediate annealing, further cold rolling was performed to produce aluminum alloy sheet of 0.3 mm thickness. It should be noted that, in the following Table B-1, the values out of claimed range are shown with underline.

TABLE B-1

| | CHEMICAL COMPOSITION (Wt %) (B: ppm) | | | | | |
|---|---|---|---|---|---|---|
| No. | Si | Fe | Ti | Ni | B | Ni/Si |
| EXAMPLE | | | | | | |
| B1 | 0.04 | 0.33 | 0.01 | 0.051 | 1 | 1.27 |
| B2 | 0.07 | 0.38 | 0.03 | 0.015 | 13 | 0.21 |
| B3 | 0.03 | 0.29 | 0.02 | 0.022 | 32 | 0.73 |
| COMPARATIVE EXAMPLE | | | | | | |
| B4 | 0.05 | 0.33 | 0.01 | 0.017 | 0.2 | 0.34 |
| B5 | 0.03 | 0.30 | 0.03 | 0.033 | 61 | 1.10 |

Next, for respective aluminum alloy produced as set forth above, degreasing, neutralization washing, dipping and alternate current electrolytic treatment and desmutting treatment were performed by conditions shown in Table A-2. Thereafter, dipping without applying power was performed. Then, respective aluminum alloy sheet were washed and dried. Then, the aluminum alloy sheets were cut into a given size as samples.

Thereafter, with respect to respective samples, graining ability and uniformity were evaluated in the similar manner with the similar evaluation standard to the foregoing first embodiment A. The results are shown in the following Table B-2.

TABLE B-2

| | No | GRAINING ABILITY EVALUATION | UNIFORMITY EVALUATION |
|---|---|---|---|
| EXAMPLE | B1 | ○ | ◎ |
| | B2 | ○ | ◎ |
| | B3 | ○ | ◎ |
| COMPARATIAVE EXAMPLE | B4 | ○ | ○ |
| | B5 | ○ | X |

As shown in the foregoing Table B-2, concerning the examples B1 to B3, evaluation of graining ability was quite good since respective elements were contained within ranges defined by the present invention and a predetermined amount of B was further contained.

On the other hand, comparative example No. B4 contains B in amount of 0.2 Wt p.p.m. which is smaller than that defined by the present invention. Therefore, uniformity was not evaluated as particularly excellent. Also, comparative example No. B5 contains 61 wt p.p.m. of B which is greater than the range defined by the present invention. Therefore, in the comparative example No. B5, the uniformity was degraded.

Embodiment C

Next, as embodiment C of the present invention, discussion will be given for the case where aluminum alloy sheet for printing plate is manufactured by providing homogenization treatment, rolling treatment and so forth for the predetermined aluminum alloy ingot. At first, by facing the aluminum ingots respectively having chemical compositions of the examples No. A1 to No. A3 of the Table A-1 and an example No. B1 of the Table B-1, into a thickness of 470 mm. Then, homogenization treatment and hot rolling treatment were performed under the condition shown in the following Table C-1. After hot rolling, cold rolling and intermediate annealing are performed and final cold roller was further performed to produce 0.3 mm of aluminum alloy sheets. It should be noted that, in the following Table C-1, the value out of the range defined by the present invention are shown with underline.

Next, for respective aluminum alloy sheets, degreasing, neutralization washing, dipping and alternate current electrolytic treatment and desmutting treatment were performed in order under the conditions shown in the foregoing Table A-2. Then, the aluminum alloy sheets were cut into a given size as samples.

Thereafter, with respect to respective samples, graining ability and uniformity were evaluated in the similar manner with the similar evaluation standard to the foregoing first embodiment A. The results are shown in the following Table C-1 together with the temperature condition in the aluminum alloy sheet manufacturing treatment.

TABLE C-1

| | No. | ALLOY No. | SOAKING TEMPERATURE (°C.) | HOT ROLLING START TEMPERATURE (°C.) | GRAINING ABILITY EVALUATION | UNIFORMITY EVALUATION |
|---|---|---|---|---|---|---|
| EXAMPLE | C1 | A1 | 525 | 439 | ○ | ○ |
| | C2 | A2 | 594 | 448 | ○ | ○ |
| | C3 | A3 | 543 | 411 | ○ | ○ |
| | C4 | B1 | 550 | 423 | ○ | ⊙ |
| COMPARATIAVE EXAMPLE | C5 | A1 | 488 | 435 | ○ | X |
| | C6 | A2 | 640 | 443 | X | ○ |
| | C7 | A3 | 515 | 375 | ○ | X |
| | C8 | A2 | 579 | 473 | ○ | X |
| | C9 | B1 | 563 | 361 | ○ | X |

As shown in the foregoing Table C-1, concerning all of the examples Nos. C1 to C4, both graining ability and uniformity were good.

On the other hand, concerning comparative example No. C5, while evaluation of graining ability was good, uniformity was no good for lower homogenization treatment temperature than the predetermined temperature. Also, concerning comparative example No. C6, while uniformity was good, graining ability was no good since the homogenization treatment temperature is higher than the predetermined temperature and starting points of initial pits during electrolytic surface graining treatment was too small number.

Concerning comparative examples Nos. C7, C8 and C9, all of the hot rolling start temperatures are out of the predetermined range. In the comparative examples Nos. C7 and C9 having low starting temperature, crystal structure in rolled sheets became un-uniform. On the other hand, in the comparative example No. C8, having excessively higher starting temperature, crystal grain grew excessively in hot pass. Therefore, in all of these comparative examples, while evaluations of graining were good, uniformity were not good.

Embodiment D

An aluminum alloy ingot having chemical compositions shown in the following Table D-1 was faced to make a thickness of 480 mm. Then, the aluminum alloy ingot was subject homogenization treatment at 610° C. for four hours. Subsequently, hot rolling treatment is performed at 410° C. of rolling start temperature. Thereafter, cold rolling, intermediate annealing, further cold rolling were performed in order to produce aluminum alloy sheet of 0.3 mm thickness.

TABLE D-1

| | CHEMICAL COMPOSITION (Wt %) | | | | | |
|---|---|---|---|---|---|---|
| No. | Si | Fe | Ni | Ti | Cu | Zn |
| EXAMPLE | | | | | | |
| D1 | 0.07 | 0.28 | 0.007 | 0.044 | 0.005 | — |
| D2 | 0.11 | 0.43 | 0.028 | 0.027 | 0.012 | 0.006 |
| D3 | 0.06 | 0.30 | 0.179 | 0.007 | 0.037 | — |
| D4 | 0.08 | 0.28 | 0.034 | 0.021 | 0.007 | — |
| COMPARATIVE EXAMPLE | | | | | | |
| D5 | 0.19 | 0.28 | 0.012 | 0.031 | 0.006 | — |
| D6 | 0.06 | 0.16 | 0.041 | 0.022 | 0.009 | 0.006 |
| D7 | 0.05 | 0.67 | 0.113 | 0.019 | 0.016 | 0.005 |

TABLE D-1-continued

| | CHEMICAL COMPOSITION (Wt %) | | | | | |
|---|---|---|---|---|---|---|
| No. | Si | Fe | Ni | Ti | Cu | Zn |
| D8 | 0.04 | 0.30 | 0.003 | 0.021 | 0.019 | — |
| D9 | 0.07 | 0.26 | 0.213 | 0.016 | 0.037 | — |
| D10 | 0.08 | 0.31 | 0.018 | 0.069 | 0.005 | — |
| D11 | 0.06 | 0.33 | 0.028 | 0.021 | 0.002 | — |
| D12 | 0.06 | 0.52 | 0.042 | 0.015 | 0.061 | 0.043 |
| D13 | 0.08 | 0.39 | 0.039 | 0.033 | 0.003 | 0.002 |
| D14 | 0.05 | 0.39 | 0.022 | 0.014 | 0.010 | 0.062 |

Next, for respective aluminum alloy sheet produced as set forth above, degreasing and neutralization washing were performed by treatment conditions 1 and 2 shown in the foregoing Table A-2. Thereafter, alternate current electrolytic surface graining treatment was performed. Then, desmutting treatment for removing oxide and so forth formed by electrolytic treatment was performed. After completion of desmutting treatment, respective aluminum alloy sheet were washed and dried.

Cut sheets of respective aluminum alloy sheet completed the series of surface graining treatment were observed by means of SEM at magnification of 350 and a photomicrograph is taken so that the field of vision becomes 0.02 $mm^2$. On the basis of this photomicrograph, areas of the portions where were not grained, were derived. Then, non-grained ratio was derived according to the equation 1.

As set forth above, with the non-grained ratio thus derived, graining ability was evaluated. Namely, when the non-grained area being less than or equal to 8.0% is indicated by ○ (good), and being exceeding 8.0% is indicated X (no good).

The grained surfaces of respective cut sheets were observed by means of SEM and a photomicrograph is taken at a magnification of 500. On the photomicrograph, total 100 cm of lines are drawn to measure sizes of pits below the lines. At this time, when a difference of sizes of the minimum pit and the maximum pit is greater than 3 μm, uniformity is evaluated as no good (X), is 2 to 3 μm, uniformity is evaluated as good (○), and is less than or equal to 2 μm, uniformity is evaluated as excellent (◎).

In the following Table D-2, treatment condition and evaluation, non-grained portion and uniformity are shown. It should be noted that, in each examples and comparative examples, respective evaluation under the treatment condition 1 and that under the treatment condition 2 are the same.

TABLE D-2

| | No. | TREATMENT CONDITION | GRAINING ABILITY EVALUATION | UNIFORMITY EVALUATION |
|---|---|---|---|---|
| EXAMPLE | D1 | 1 | ○ | ◎ |
| | D2 | 1 | ○ | ◎ |
| | D3 | 1 | ○ | ◎ |
| | D4 | 2 | ○ | ○ |
| COMPARATIVE EXAMPLE | D5 | 2 | X | X |
| | D6 | 1 | X | X |
| | D7 | 1 | ○ | X |
| | D8 | 2 | X | X |
| | D9 | 2 | ○ | X |
| | D10 | 1 | ○ | X |
| | D11 | 2 | ○ | ○ |
| | D12 | 1 | X | ○ |
| | D13 | 2 | X | ○ |
| | D14 | 2 | ○ | ○ |

As shown in the foregoing Table D-2, concerning the examples D1 to D4, non-grained portion evaluation and uniformity evaluation were all goods.

On the other hand, comparative example No. D5 shows the case where Si content 0.19 Wt % is greater than the predetermined amount defined by the present invention, fluctuation has been caused in the pit size.

Comparative example No. D6 shows the case where the Fe content 0.16 Wt % is too small, non-grained portion was left on the surface of the aluminum alloy sheet. On the other hand, comparative example No. D7 has Fe content 0.67 Wt % which is excessively large, fluctuation was caused in the pit size and uniformity was no good.

Comparative example No. D8 has Ni content 0.003 Wt % which is too small, non-grained portion was caused. In the comparative example No. D9, since Ni content 0.213 Wt % being too large, uniformity was no good.

On the other hand, comparative example No. D10 has Ti content 0.069 being too large, uniformity of pit was no good.

Comparative example No. D11 has Cu content 0.002 Wt % being too small, non-grained portion was caused. Also, uniformity was no good. On the other hand, comparative example No. D12 has Cu content 0.061 Wt % being too large, non-grained portion was caused.

Comparative example No. D13 has Zn content 0.002 being too small, non-grained portion was left. On the other hand, comparative example No. D14 has Zn content 0.062 Wt % being too large, dissolving with Smooth surface was caused and uniformity was no good.

Embodiment E

Aluminum alloy ingots having chemical composition shown in the following Table E-1 (examples Nos. E1 to E6 and comparative examples Nos. E7 to E16) were faced to make a thickness of 470 mm. Then, the aluminum alloy ingot was subject homogenization treatment at 590° C. for four hours. Subsequently, hot rolling treatment is performed at 430° C. of rolling start temperature. Thereafter, cold rolling is performed. Then, after performing intermediate annealing, further cold rolling was performed to produce aluminum alloy sheet of 0.3 mm thickness. It should be noted that chemical components of respective aluminum alloy sheets are measured utilizing emission spectroscopic method. On the other hand, content of intermetallic compound was measured by dissolving aluminum alloy sheet by dehydrated phenol, filtering the solution and measuring residue (intermetallic compound) by extinction method and atomic absorption spectrophotometric method.

TABLE E-1

| | CHEMICAL COMPOSITION (Wt %) | | | | | |
|---|---|---|---|---|---|---|
| No. | Si | Fe | Ti | Ni | INTER-METALLIC COMPOUND | REMARKS |
| EXAMPLE | | | | | | |
| E1 | 0.03 | 0.30 | 0.01 | 0.03 | 1.03 | |
| E2 | 0.03 | 0.30 | 0.01 | 0.100 | 1.50 | |
| E3 | 0.10 | 0.31 | 0.02 | 0.020 | 1.45 | |
| E4 | 0.05 | 0.55 | 0.04 | 0.033 | 1.93 | |
| E5 | 0.05 | 0.25 | 0.03 | 0.052 | 1.14 | |
| E6 | 0.03 | 0.25 | 0.01 | 0.010 | 0.83 | |
| COMPARATIVE EXAMPLE | | | | | | |
| E7 | 0.03 | 0.30 | 0.01 | 0.004 | 0.96 | Ni: SMALL |
| E8 | 0.03 | 0.30 | 0.01 | 0.300 | 1.64 | Ni: LARGE |
| E9 | 0.20 | 0.30 | 0.01 | 0.05 | 1.91 | Si: LARGE |
| E10 | 0.01 | 0.32 | 0.003 | 0.05 | 0.49 | Si, Ti: SMALL |
| E11 | 0.03 | 0.15 | 0.01 | 0.05 | 0.47 | Fe: SMALL |
| E12 | 0.03 | 0.70 | 0.01 | 0.07 | 2.33 | Fe: LARGE COMPOUND: LARGE |
| E13 | 0.03 | 0.30 | 0.003 | 0.03 | 1.18 | Ti: SMALL |
| E14 | 0.03 | 0.30 | 0.06 | 0.10 | 1.23 | Ti: LARGE |
| E15 | 0.15 | 0.60 | 0.01 | 0.03 | 2.51 | COMPOUND: LARGE |
| E16 | 0.03 | 0.20 | 0.01 | 0.01 | 0.47 | COMPOUND: SMALL |

Next, for respective aluminum alloy sheet produced as set forth above, degreasing and neutralization washing were performed by treatment conditions 1 and 2 shown in the Table A-2. Thereafter, alternate current electrolytic surface graining treatment was performed. Then, desmutting treatment for removing oxide and so forth formed by electrolytic treatment was performed. After completion of desmutting treatment, respective aluminum alloy sheet were washed and dried. Then, the aluminum alloy sheets were cut into a given size as samples.

Non-grained portion and Uniformity of respective samples are evaluated by the following tests.

Evaluation Standard of Graining Ability

The grained surfaces of respective samples were observed by means of scanning electron microscope (SEM) at magnification of 350 and a photomicrograph is taken so that the field of vision becomes 0.02 $mm^2$. On the basis of this photomicrograph, areas of the portions where were not grained, were derived. Then, non-graining ratio was derived according to the foregoing equation 3.

On the basis of results of calculation, when the non-grainined area being less than or equal to 8.0% is indicated by ○(good), and being more than 8.0% is indicated by X (no good).

Evaluation Standard of Uniformity

The grained surfaces of respective samples were observed by means of SEM and a photomicrograph is taken at a magnification of 500. On the photomicrograph, total 100 cm of lines are drawn to measure sizes of pits below the lines. At this time, when a difference of sizes of the minimum pit and the maximum pit is less than or equal to 2 μm, uniformity is evaluated as excellent (◎), is 2 to 3 μm, uniformity is evaluated as good (○), and is more than 3 μm, uniformity is evaluated as no good (X).

In the following Table E-2, treatment condition and evaluation of non-graining portion and uniformity are shown. It should be noted that, in each examples and comparative examples, respective evaluation under the treatment condition 1 and that under the treatment condition 2 are the same.

TABLE E-2

| | No. | GRAINING ABILITY EVALUATION | UNIFORMITY EVALUATION |
|---|---|---|---|
| EXAMPLE | E1 | ○ | ○ |
| | E2 | ○ | ○ |
| | E3 | ○ | ○ |
| | E4 | ○ | ○ |
| | E5 | ○ | ○ |
| | E6 | ○ | ○ |
| COMPARATIVE EXAMPLE | E7 | X | X |
| | E8 | ○ | X |
| | E9 | X | X |
| | E10 | ○ | X |
| | E11 | X | X |
| | E12 | ○ | X |
| | E13 | ○ | X |
| | E14 | ○ | X |
| | E15 | ○ | X |
| | E16 | X | X |

As shown in the foregoing Table E-2, in the examples Nos. E1 to E6, since contents of respective elements are within the ranges defined in the present invention, both of graining ability evaluation and uniformity evaluation were good.

On the other hand, in comparative example No. E7, since the Ni content is 0.004 Wt % which is smaller than the range defined by the present invention, initial bit and chemical-etch ability were insufficient. Therefore, large number of non-grained portions were left. Also, fluctuation of pit size was large to degrade uniformity. On the other hand, comparative example No. E8, Ni content is 0.300 Wt % which is larger than the range defined by the present invention. Thus, chemical-etch ability becomes excessively promoted to make uniformity no good.

In the comparative example No. E9, since Si content is 0.20 Wt % being too large amount, large grain size compound was formed, and electrolytically grained surface became ununiform to make both of non-grained portion evaluation and uniformity evaluation no good. On the other hand, in comparative example No. E10, since Si content is 0.01 Wt % being smaller amount, the intermetallic compound became too small amount to make formation of initial pit insufficient. On the other hand, since Ti content is 0.003 Wt % being too small amount, refining of cast structure was insufficient. Therefore, uniformity evaluation became no good.

In the comparative example No. E11, Fe content is 0.15 Wt % being too small amount, the initial pit amount upon electrolytic surface graining treatment became too small amount to make both of non-grained portion evaluation and uniformity evaluation no good.

In the comparative example No. E12, since Fe content is 0.70 Wt % being too large amount, large amount of intermetallic compound was formed. The content of the intermetallic compound then became 2.33 Wt % being large. Therefore, large grain size compound was formed, and electrolytically grained surface became un-uniform.

In the comparative example No. E13, since Ti content is 0.003 Wt % being too small, refining of crystal grain became insufficient to form un-uniform pits. Thus, uniformity evaluation became no good. On the other hand, in the comparative example No. E14, Ti content is 0.06 Wt % being too large amount, large grain size compound was formed, pit size became un-uniform, and uniformity evaluation became no good.

In the comparative example No. E15, since content of intermetallic compound is 2.51 Wt % being too large, large pit is formed to make uniformity no good.

In the comparative example No. E16, the content of intermetallic compound is 0.47 Wt % being too small, initial pit became too small amount to lead non-grained portion. Thus, non-grained portion evaluation became no good. Also, fluctuation is caused in pit size to make uniformity no good.

Next, discussion will be given for embodiment of manufacturing method of the aluminum alloy sheet for printing plate.

Embodiment F

Aluminum alloy ingots having chemical composition of example E1 shown in the foregoing Table E-1 were faced to make a thickness of 470 mm. Next, under the condition shown in the following Table F-1, homogenization treatment and hot rolling treatment were performed and further cold rolling, intermediate annealing and cold rolling are performed to obtain aluminum alloy sheet of thickness of 0.3 mm (example Nos. F1 to F3 and comparative example Nos. F4 to F7). It should be noted that chemical composition and content of intermetallic compound are measured in the same measuring method to the embodiment E.

Next, for respective aluminum alloy sheet produced as set forth above, degreasing and neutralization washing, alternate current electrolytic surface graining treatment and desmutting treatment were performed in order under the conditions shown in foregoing Table A-2. After completion of desmutting treatment, each aluminum alloy sheet were washed and dried. Then, the aluminum alloy sheets were cut into a given size as samples. Then, non-grained portion and uniformity were evaluated in the similar test method and evaluation standard to the foregoing embodiment E. The results are shown in the following Table F-1.

TABLE F-1

| | No. | HOMOGENIZATION TREATMENT TEMPERATURE (°C.) | HOT ROLLING START TEMPERATURE (°C.) | INTERMETALLIC COMPOUND (Wt %) | GRAINING ABILITY EVALUATION | UNIFORMITY EVALUATION | REMARKS |
|---|---|---|---|---|---|---|---|
| EXAMPLE | F1 | 525 | 439 | 1.57 | ○ | ○ | |
| | F2 | 594 | 448 | 1.01 | ○ | ○ | |
| | F3 | 543 | 411 | 1.33 | ○ | ○ | |
| COMPARATIVE EXAMPLE | F4 | 488 | 435 | 2.08 | ○ | X | SOKING LOW TEMPERATURE |
| | F5 | 640 | 443 | 0.46 | X | X | SOAKING HIGH TEMPERATURE |
| | F6 | 515 | 375 | 0.48 | X | X | HOT ROLLING LOW TMPERATURE |
| | F7 | 579 | 473 | 2.03 | ○ | X | HOT ROLLING HIGH TEMPERTURE |

As shown in the foregoing Table F-1, in the examples F1 to F3, evaluations of non-grained portion and uniformity are all good.

On the other hand, in the comparative example No. F4, the homogenization treatment temperature is 488° C. which is lower than the temperature defined in the present invention. Therefore, the intermetallic compound was precipitated in the amount of 2.08 Wt % being large amount. Therefore, large pits are formed on the electrolytically grained surface to make evaluation of uniformity no good.

In comparative example No. F5, the homogenization treatment temperature is 640° C. which is higher than the temperature range defined by the present invention, the content of the intermetallic compound becomes 0.46 Wt % which is smaller than that of defined. Therefore, formation of initial pits was insufficient and large amount of non-grained portion was left and uniformity is no good.

In the comparative example No. F6, the hot rolling start temperature is 375° C. which is lower than the temperature range defined in the present invention. Therefore, precipitation amount of the intermetallic compound was 0.48 Wt % which is too small. Therefore, initial pit lacks to cause non-grained portion evaluation no good and uniformity is no good.

In the comparative example No. F7, the hot rolling start temperature is 473° C. which is higher than the temperature range defined in the present invention. Therefore, precipitation amount of the intermetallic compound was 2.03 Wt % which is excessive. Therefore, uniformity of electrolytically grained surface is degraded.

Embodiment G

For aluminum alloy ingots having chemical compositions (examples G1 to G6 and comparative example G7 to G28) shown in the following Table G-1, similar treatment to those in the embodiment E was performed to obtain the aluminum alloy sheets. The properties of the obtained aluminum alloy sheets were evaluated.

TABLE G-1

| | No. | CHEMICAL COMPOSITION (Wt %) Fe | Si | Ni | Ti |
|---|---|---|---|---|---|
| EXAMPLE | G1 | 0.30 | 0.03 | 0.030 | 0.01 |
| | G2 | 0.30 | 0.03 | 0.100 | 0.01 |
| | G3 | 0.31 | 0.10 | 0.020 | 0.02 |
| | G4 | 0.55 | 0.05 | 0.033 | 0.04 |
| | G5 | 0.25 | 0.05 | 0.052 | 0.03 |
| | G6 | 0.25 | 0.03 | 0.010 | 0.01 |
| COMPARATIVE EXAMPLE | G7 | 0.62 | 0.03 | 0.03 | 0.01 |
| | G8 | 0.18 | 0.04 | 0.02 | 0.02 |
| | G9 | 0.33 | 0.17 | 0.03 | 0.01 |
| | G10 | 0.35 | 0.02 | 0.04 | 0.01 |
| | G11 | 0.35 | 0.05 | 0.22 | 0.01 |
| | G12 | 0.33 | 0.03 | 0.003 | 0.01 |
| | G13 | 0.33 | 0.04 | 0.03 | 0.004 |
| | G14 | 0.33 | 0.03 | 0.04 | 0.06 |
| | G15 | 0.57 | 0.03 | 0.03 | 0.01 |
| | G16 | 0.20 | 0.03 | 0.03 | 0.01 |
| | G17 | 0.31 | 0.13 | 0.03 | 0.01 |
| | G18 | 0.33 | 0.03 | 0.03 | 0.01 |
| | G19 | 0.33 | 0.04 | 0.18 | 0.01 |
| | G20 | 0.33 | 0.03 | 0.006 | 0.01 |
| | G21 | 0.70 | 0.03 | 0.03 | 0.01 |
| | G22 | 0.15 | 0.03 | 0.03 | 0.01 |
| | G23 | 0.33 | 0.20 | 0.03 | 0.01 |
| | G24 | 0.35 | 0.01 | 0.03 | 0.01 |
| | G25 | 0.35 | 0.03 | 0.25 | 0.01 |
| | G26 | 0.35 | 0.03 | 0.004 | 0.01 |
| | G27 | 0.60 | 0.15 | 0.20 | 0.03 |
| | G28 | 0.20 | 0.03 | 0.005 | 0.007 |

TABLE G-1-continued

| | No. | INTERMETALLIC COMPOUND (Wt %) Fe | Si | Ni | REMARKS |
|---|---|---|---|---|---|
| EXAMPLE | G1 | 25.07 | 0.58 | 2.99 | |
| | G2 | 23.95 | 0.41 | 6.50 | |
| | G3 | 22.84 | 0.80 | 1.99 | |
| | G4 | 29.13 | 0.37 | 2.87 | |
| | G5 | 20.22 | 0.64 | 4.55 | |
| | G6 | 21.11 | 0.41 | 1.37 | |
| COMPARATIVE EXAMPLE | G7 | 29.81 | 0.58 | 2.99 | Fe:LARGE |
| | G8 | 20.14 | 0.61 | 1.89 | Fe:SMALL |
| | G9 | 25.84 | 0.77 | 2.82 | Si:LARGE |
| COMPARATIVE EXAMPLE | G10 | 25.13 | 0.32 | 3.87 | Si:SMALL |
| | G11 | 25.22 | 0.64 | 9.55 | Ni:LARGE |
| | G12 | 26.11 | 0.51 | 0.34 | Ni:SMALL |
| | G13 | 25.11 | 0.65 | 2.82 | Ti:SMALL |
| | G14 | 25.45 | 0.56 | 3.62 | Ti:LARGE |
| | G15 | 30.21 | 0.59 | 2.94 | COMPOUND Fe:LARGE |
| | G16 | 19.84 | 0.60 | 2.89 | COMPOUND Fe:SMALL |
| | G17 | 25.85 | 0.83 | 3.15 | COMPOUND Si:LARGE |
| | G18 | 20.13 | 0.29 | 2.79 | COMPOUND Si:SMALL |
| | G19 | 25.31 | 0.53 | 10.06 | COMPOUND Ni:LARGE |
| | G20 | 25.04 | 0.61 | 0.27 | COMPOUND Ni:SMALL |
| | G21 | 34.31 | 0.55 | 2.92 | Fe:LARGE COMPOUND Fe:LARGE |
| | G22 | 19.71 | 0.53 | 2.83 | Fe:SMALL COMPOUND Fe:SMALL |
| | G23 | 25.16 | 0.90 | 2.92 | Si:LARGE COMPOUND Si:LARGE |
| | G24 | 25.34 | 0.21 | 3.11 | Si:SMALL COMPOUND Si:SMALL |
| | G25 | 26.45 | 0.61 | 12.37 | Ni:LARGE COMPOUND Ni:LARGE |
| | G26 | 26.88 | 0.57 | 0.21 | Ni:SMALL COMPOUND Ni:SMALL |
| | G27 | 30.23 | 0.83 | 11.31 | COMPOUND Fe, Si,Ni:LARGE |
| | G28 | 19.16 | 0.27 | 0.29 | COMPOUND Fe, Si,Ni:SMALL |

TABLE G-2

| No. | GRAINING ABILITY EVALUATION | UNIFORMITY EVALUATION |
|---|---|---|
| EXAMPLE | | |
| G1 | ○ | ○ |
| G2 | ○ | ○ |
| G3 | ○ | ○ |
| G4 | ○ | ○ |
| G5 | ○ | ○ |
| G6 | ○ | ○ |
| COMPARATIVE EXAMPLE | | |
| G7 | ○ | x |
| G8 | x | x |
| G9 | x | x |
| G10 | ○ | x |
| G11 | ○ | x |
| G12 | x | x |
| G13 | ○ | x |
| G14 | ○ | x |
| G15 | ○ | x |
| G16 | x | x |
| G17 | ○ | x |

TABLE G-2-continued

| No. | GRAINING ABILITY EVALUATION | UNIFORMITY EVALUATION |
|---|---|---|
| G18 | x | x |
| G19 | ○ | x |
| G20 | x | x |
| G21 | ○ | x |
| G22 | x | x |
| G23 | x | x |
| G24 | x | x |
| G25 | ○ | x |
| G26 | x | x |
| G27 | ○ | x |
| G28 | x | x |

As shown in the foregoing Table G-2, in the examples G1 to G6, since the contents of respective elements fall within the ranges defined by the present invention, and also the contents of respective elements in the intermetallic compound fall within respective ranges defined by the present invention, both of the graining ability evaluation and uniformity evaluation were good.

In the comparative example No. G7, since the Fe content 0.62 Wt % is larger than the content defined the present invention. Therefore, large grain size compound was formed to make the electrolytically grained surface un-uniform. In the comparative example No. G8, since the Fe content 0.18 Wt % is smaller than the content defined the present invention. Therefore, formation of initial pit during electrolytic surface graining treatment became insufficient. As a result, both of the non-grained portion evaluation and the uniformity evaluation were no good.

In the comparative example No. G9, since the Si content 0.17 Wt % in the aluminum alloy sheet is larger than that defined, large grain compound was creased and both of the uniformity evaluation and graining ability was no good. On the other hand, in the comparative example No. G10, the Si content 0.02 Wt % in the aluminum alloy sheet is smaller than that defined, and fluctuation of sizes of the pits becomes significant to make the uniformity no good.

In the comparative example No. G11, the since the Ni content 0.22 Wt % in the aluminum alloy sheet is larger than that defined, chemical-etch ability became excessively high and the uniformity evaluation was no good. On the other hand, in the comparative example No. G12, the Ni content 0.34 Wt % in the aluminum alloy sheet is smaller than that defined, formation of the initial pit becomes insufficient to cause large amount of non-grained portions, and the uniformity evaluation was no good.

In the comparative example No. G13, since Ti content 0.004 Wt % of the aluminum alloy sheet is smaller than that defined by the invention, re-fining effect became insufficient to lower uniformity. On the other hand, in the comparative example No. G14, since the content 0.06 of the aluminum alloy sheet is larger than that defined. Thus, large grain size compound was formed to make uniformity evaluation no good.

In the comparative example No. G15, the Fe content 30.21 Wt % in the intermetallic compound is larger than that defined range, uniformity of the electrolytically grained surface is degraded to make the uniformity evaluation no good. On the other hand, in the comparative example No. G16, Fe content 19.84 Wt % in the intermetallic compound is smaller than that defined, improvement of graining ability was insufficient and non-grained portion was formed. Also, uniformity was lowered.

In the comparative example No. G17, Si content 0.83 Wt % in the intermetallic compound is larger than that defined, uniformity of the electrolytically grained surface is degraded to make uniformity evaluation no good. On the other hand, in the comparative example No. G18, Si content 0.29 Wt % in the intermetallic compound is smaller than that defined, improvement of graining ability was insufficient, and thus non-grained portion evaluation was no good. Also, the uniformity evaluation was no good.

In the comparative example No. G19, Ni content 10.06 Wt % in the intermetallic compound is larger than that defined, uniformity became no good. On the other hand, in the comparative example No. G20, Ni content 0.27 Wt % in the intermetallic compound is smaller than that defined, both of non-grained evaluation and uniformity evaluation were no good.

In the comparative example No. G21, Fe content 0.70 Wt % in the aluminum alloy sheet is larger than that defined, Fe content of the intermetallic compound became large to be 34.31 Wt %. Therefore, uniformity of the electrolytically grained surface is degraded to make the uniformity evaluation no good. On the other hand, in the comparative example No. G22, Fe content 0.15 Wt % in the intermetallic compound is smaller than that defined, the Fe content in the intermetallic compound became smaller to be 19.71 Wt %. Therefore, uniformity evaluation and non-grained portion evaluation became no good.

In the comparative example No. G23, Si content 0.20 Wt % of the aluminum alloy sheet is larger than that defined, the Si content in the intermetallic compound became larger to be 0.90 Wt %. Therefore, uniformity of the electrolytically grained surface is degraded to make the uniformity evaluation no good. On the other hand, in the comparative example No. G24, Si content 0.01 Wt % of the aluminum alloy sheet is smaller than that defined, Si content of the intermetallic compound became smaller to be 0.21 Wt %. Therefore, uniformity evaluation became no good and non-grained portion evaluation became no good.

In the comparative example No. G25, Ni content 0.25 Wt % of the aluminum alloy sheet is larger than that defined, the Ni content in the intermetallic compound became larger to be 12.37 Wt %. Therefore, uniformity of the electrolytically grained surface is lowered. On the other hand, in the comparative example No. G26, Ni content 0.004 Wt % of the aluminum alloy sheet is smaller than that defined, Ni content of the intermetallic compound became smaller to be 0.21 Wt %. Therefore, uniformity evaluation became no good and non-grained portion evaluation became no good.

In the comparative example No. G27, Fe, Si and Ni contents of intermetallic compound respectively 30.23, 0.83 and 11.31 Wt % are larger than those defined. Therefore, uniformity of the electrolytically grained surface was no good.

In the comparative example No. G28 Fe, Si and Ni contents of intermetallic compound respectively 19.16, 0.27 and 0.29 smaller than those defined. Therefore, graining ability could not be improved to cause non-grained portion. Also, uniformity evaluation became no good.

Embodiment H

For aluminum alloy ingots having chemical composition of example G1 shown in the foregoing Table G-1, similar treatment to those in the embodiment E was performed to obtain the aluminum alloy sheets. The properties of the obtained aluminum alloy sheets were evaluated.

TABLE H-1

| | No. | HOMOGENIZATION TREATMENT TEMPERATURE (°C.) | HOT ROLLING START TEMPERATURE (°C.) | INTERMETALLIC COMPOUND (Wt %) Fe | Si | Ni |
|---|---|---|---|---|---|---|
| EXAMPLE | H1 | 525 | 439 | 26.76 | 0.67 | 3.12 |
| | H2 | 594 | 448 | 25.07 | 0.58 | 2.99 |
| | H3 | 543 | 411 | 27.91 | 0.77 | 3.08 |
| COMPARATIVE EXAMPLE | H4 | 488 | 435 | 31.20 | 0.76 | 6.11 |
| | H5 | 640 | 443 | 19.46 | 0.28 | 1.07 |
| | H6 | 515 | 375 | 19.36 | 0.27 | 0.83 |
| | H7 | 579 | 473 | 30.02 | 0.58 | 5.06 |

| | No. | GRAINING ABILITY EVALUATION | UNIFORMITY EVALUATION | REMARKS |
|---|---|---|---|---|
| EXAMPLE | H1 | ○ | ○ | |
| | H2 | ○ | ○ | |
| | H3 | ○ | ○ | |
| COMPARATIVE EXAMPLE | H4 | ○ | X | SOAKING LOW TEMPERATURE, INTERMETALLIC COMPOUND Fe; LARGE |
| | H5 | X | X | SOAKING HIGH TEMPERATURE, INTERMETALLIC COMPOUND Fe,Si; SMALL |
| | H6 | X | X | HOT ROLLING LOW TEMPERATURE, INTERMETALLIC COMPOUND Fe,Si; SMALL |
| | H7 | ○ | X | HOT ROLLING HIGH TEMPERATURE, INTERMETALLIC COMPOUND Fe; LARGE |

As shown in the foregoing Table H-1, in the examples H1 to H3, both of the graining ability evaluation and uniformity evaluation were good.

On the other hand, in the comparative example No. H4, the homogenization treatment temperature is 488° C. which is lower than the temperature defined in the present invention. Therefore, Fe content in the intermetallic compound became large to be 31.20 Wt %. Thus, large pits are formed on the electrolytically grained surface to make evaluation of uniformity no good.

In comparative example No. H5, the homogenization treatment temperature is 640° C. which is higher than the temperature range defined by the present invention, the Fe content of the intermetallic compound became 19.46 Wt % which is smaller than that of defined, and Si content became 0.28 Wt % which is smaller than that defined. Therefore, large amount of non-grained portion was left. Also, uniformity was no good.

In the comparative example No. H6, the hot rolling start temperature is 375° C. which is lower than the temperature range defined in the present invention. Therefore, Fe content in the intermetallic compound became small to be 19.36 Wt %. Thus, fluctuation was caused in the pit size to make uniformity evaluation no good.

In the comparative example No. H7, the hot rolling start temperature is 473° C. which is higher than the temperature range defined in the present invention. Therefore, Fe content in the intermetallic compound became large to be 30.02 Wt %. Thus, large pit can be formed on the electrolytically grained surface to make uniformity evaluation no good.

Embodiment I

Aluminum alloy ingots having chemical composition shown in the following Table I-1 was faced to make a thickness of 470 mm. Then, the aluminum alloy ingots were subject homogenization treatment at 590° C. for four hours. Subsequently, hot rolling treatment is performed at 430° C. of rolling start temperature. Thereafter, cold rolling, intermediate annealing, and further cold rolling were performed in order to produce aluminum alloy sheet of 0.3 mm thickness.

It should be noted that the chemical components of respective aluminum alloy sheets were measured employing emission spectroscopic method.

On the other hand, chemical components of aluminum matrix was measured as follows. At first, aluminum alloy sheet was dissolved by dehydrated phenol. Then, solution was filtered by a membrane filter having pore size of 0.45 μm. Filtered solution (residue, intermetallic compound) was analyzed by absorptiometric method and atomic absorption method. Differences between the chemical components of the aluminum alloy sheet and chemical components of the intermetallic compound were calculated to derive Fe, Si and Ni contents in aluminum matrix.

TABLE I-1

| | | CHEMICAL COMPOSITION (Wt %) | | | |
|---|---|---|---|---|---|
| | No. | Fe | Si | Ni | Ti |
| EXAMPLE | I1 | 0.30 | 0.03 | 0.030 | 0.01 |
| | I2 | 0.30 | 0.03 | 0.100 | 0.01 |
| | I3 | 0.31 | 0.10 | 0.020 | 0.02 |
| | I4 | 0.55 | 0.05 | 0.033 | 0.04 |
| | I5 | 0.25 | 0.05 | 0.052 | 0.03 |
| | I6 | 0.25 | 0.03 | 0.010 | 0.01 |
| COMPARATIVE EXAMPLE | I7 | 0.62 | 0.04 | 0.03 | 0.0i |
| | I8 | 0.18 | 0.04 | 0.03 | 0.01 |
| | I9 | 0.33 | 0.17 | 0.03 | 0.01 |
| | I10 | 0.35 | 0.02 | 0.04 | 0.01 |
| | I11 | 0.35 | 0.05 | 0.22 | 0.01 |
| | I12 | 0.33 | 0.03 | 0.003 | 0.01 |
| | I13 | 0.33 | 0.04 | 0.03 | 0.004 |
| | I14 | 0.33 | 0.03 | 0.04 | 0.06 |
| | I15 | 0.57 | 0.03 | 0.03 | 0.01 |
| | I16 | 0.20 | 0.03 | 0.03 | 0.01 |
| | I17 | 0.31 | 0.13 | 0.03 | 0.01 |
| | I18 | 0.33 | 0.03 | 0.03 | 0.01 |
| | I19 | 0.33 | 0.04 | 0.18 | 0.01 |
| | I20 | 0.33 | 0.03 | 0.006 | 0.01 |
| | I21 | 0.65 | 0.03 | 0.03 | 0.01 |
| | I22 | 0.10 | 0.03 | 0.03 | 0.01 |
| | I23 | 0.33 | 0.20 | 0.03 | 0.01 |
| | I24 | 0.35 | 0.01 | 0.03 | 0.01 |
| | I25 | 0.35 | 0.03 | 0.30 | 0.01 |
| | I26 | 0.35 | 0.03 | 0.003 | 0.01 |

| | | MATRIX (Wt %) | | | |
|---|---|---|---|---|---|
| | No. | Fe | Si | Ni | REMARKS |
| EXAMPLE | I1 | 0.08 | 0.03 | 0.004 | |
| | I2 | 0.07 | 0.02 | 0.014 | |
| | I3 | 0.04 | 0.07 | 0.001 | |
| | I4 | 0.15 | 0.04 | 0.004 | |
| | I5 | 0.03 | 0.06 | 0.008 | |
| | I6 | 0.02 | 0.02 | 0.0008 | |
| COMPARATIVE EXAMPLE | I7 | 0.19 | 0.04 | 0.004 | Fe:LARGE |
| | I8 | 0.01 | 0.04 | 0.005 | Fe:SMALL |
| | I9 | 0.08 | 0.09 | 0.003 | Si:LARGE |

TABLE I-1-continued

| | | | | |
|---|---|---|---|---|
| I10 | 0.09 | 0.02 | 0.005 | Si:SMALL |
| I11 | 0.08 | 0.05 | 0.019 | Ni:LARGE |
| I12 | 0.07 | 0.04 | 0.0005 | Ni:SMALL |
| I13 | 0.08 | 0.04 | 0.003 | Ti:SMALL |
| I14 | 0.07 | 0.04 | 0.004 | Ti:LARGE |
| I15 | 0.21 | 0.04 | 0.005 | MATRIX Fe:LARGE |
| I16 | 0.008 | 0.04 | 0.004 | MATRIX Fe:SMALL |
| I17 | 0.07 | 0.11 | 0.004 | MATRIX Si:LARGE |
| I18 | 0.08 | 0.01 | 0.004 | MATRIX Si:SMALL |
| I19 | 0.08 | 0.04 | 0.022 | MATRIX Ni:LARGE |
| I20 | 0.07 | 0.03 | 0.0004 | MATRIX Ni:SMALL |
| I21 | 0.25 | 0.04 | 0.004 | Fe:LARGE MATRIX Fe:LARGE |
| I22 | 0.007 | 0.05 | 0.005 | Fe:SMALL MATRIX Fe:SMALL |
| I23 | 0.08 | 0.15 | 0.004 | Si:LARGE MATRIX Si:LARGE |
| I24 | 0.10 | 0.005 | 0.004 | Si:SMALL MATRIX Si:SMALL |
| I25 | 0.08 | 0.04 | 0.027 | Ni:LARGE MATRIX Ni:LARGE |
| I26 | 0.07 | 0.03 | 0.002 | Ni:SMALL MATRIX Ni:SMALL |

For respective aluminum alloy plates produced as set forth above, electrolytic surface graining treatment was performed under the treatment conditions 1 or 2 shown in Table A-2 similar to foregoing embodiments E. Then, properties were evaluated. Evaluation method is as discussed in the foregoing embodiment E.

TABLE I-2

| No. | GRAINING ABILITY EVALUATION | UNIFORMITY EVALUATION |
|---|---|---|
| EXAMPLE | | |
| I1 | ○ | ○ |
| I2 | ○ | ○ |
| I3 | ○ | ○ |
| I4 | ○ | ○ |
| I5 | ○ | ○ |
| I6 | ○ | ○ |
| COMPARATIVE EXAMPLE | | |
| I7 | ○ | x |
| I8 | x | x |
| I9 | ○ | x |
| I10 | x | x |
| I11 | ○ | x |
| I12 | x | x |
| I13 | ○ | x |
| I14 | ○ | x |
| I15 | ○ | x |
| I16 | x | x |
| I17 | ○ | x |
| I18 | x | x |
| I19 | ○ | x |
| I20 | x | x |
| I21 | ○ | x |
| I22 | x | x |
| I23 | ○ | x |
| I24 | x | x |
| I25 | ○ | x |
| I26 | x | x |

As shown in the foregoing Table I-2, in the examples I1 to I6, since the contents of respective elements fall within the ranges defined by the present invention, and also the contents of respective elements in the intermetallic compound fall within respective ranges defined by the present invention, both of the graining ability evaluation and uniformity evaluation were good.

In the comparative example No. I7, since the Fe content 0.62 Wt % is larger than the content defined the present invention. Therefore, large grain size compound was formed to make the electrolytically grained surface un-uniform. In the comparative example No. I8, since the Fe content 0.18 Wt % is smaller than the content defined the present invention. Therefore, Al-Fe type intermetallic compound lacked to make initial pit insufficient. As a result, both of the non-grained portion evaluation and the uniformity evaluation were no good.

In the comparative example No. I9, since the Si content 0.17 Wt % in the aluminum alloy sheet is larger than that defined, large grain compound was created to make electrolytically grained surface un-uniform and thus the uniformity evaluation was no good. On the other hand, in the comparative example No. I10, the Si content 0.02 Wt % in the aluminum alloy sheet is smaller than that defined, formation of the initial pit becomes insufficient to make both of the non-grained portion evaluation and uniformity evaluation no good.

In the comparative example No. I11, the since the Ni content 0.22 Wt % in the aluminum alloy sheet is larger than that defined, chemical-etch ability became excessively high and the uniformity evaluation was no good. On the other hand, in the comparative example No. I12, the Ni content 0.0005 Wt % in the aluminum alloy sheet is smaller than that defined, improvement of chemical-etch ability became insufficient and formation of the initial pit becomes insufficient. As a result non-grained portions evaluation and the uniformity evaluation were lowered.

In the comparative example No. I13, since Ti content 0.004 Wt % of the aluminum alloy sheet is smaller than that defined by the invention, re-fining effect became insufficient to fluctuate size of the pits and to lower uniformity. On the other hand, in the comparative example No. I14, since the content 0.06 of the aluminum alloy sheet is larger than that defined. Thus, un-uniform pits were formed.

In the comparative example No. I15, the Fe content 0.21 Wt % in the aluminum matrix is larger than that defined range, uniformity of the electrolytically grained surface is degraded. On the other hand, in the comparative example No. I16, Fe content 0.008 Wt % in the aluminum matrix is smaller than that defined, un-uniform pits were formed.

In the comparative example No. I17, Si content 0.11 Wt % in the aluminum matrix is larger than that defined, fluctuation was caused in pit size and uniformity of the electrolytically grained surface is degraded. On the other hand, in the comparative example No. I18, Si content 0.01 Wt % in the aluminum matrix is smaller than that defined, both of non-grained portion evaluation and the uniformity evaluation were no good.

In the comparative example No. I19, Ni content 0.022 Wt % in the aluminum matrix is larger than that defined, uniformity of pits became lowered. On the other hand, in the comparative example No. I20, Ni content 0.0004 Wt % in the aluminum matrix is smaller than that defined, non-grained portion was formed and uniformity evaluation were lowered.

In the comparative example No. I21, Fe content 0.65 Wt % in the aluminum alloy sheet is larger than that defined, Fe content of the aluminum matrix became large to be 0.25 Wt %. Therefore, uniformity evaluation was lowered. On the other hand, in the comparative example No. I22, Fe content 0.10 Wt % in the intermetallic compound is smaller than that defined, the Fe content in the aluminum matrix became smaller to be 0.007 Wt %. Therefore, both of non-grained portion evaluation and uniformity evaluation became no good.

In the comparative example No. I23, Si content 0.20 Wt % of the aluminum alloy sheet is larger than that defined, the Si content in the aluminum matrix became larger to be 0.15 Wt %. Therefore, uniformity of the electrolytically grained surface is degraded to make the uniformity evaluation no good. On the other hand, in the comparative example No. I24, Si content 0.01 Wt % of the aluminum alloy sheet is smaller than that defined, Si content of the aluminum matrix became smaller to be 0.005 Wt %. Therefore, uniformity evaluation became no good and non-grained portion evaluation became no good.

In the comparative example No. I25, Ni content 0.30 Wt % of the aluminum alloy sheet is larger than that defined, the Ni content in the aluminum matrix became larger to be 0.027 Wt %. Therefore, uniformity evaluation became no good. On the other hand, in the comparative example No. I26, Ni content 0.003 Wt % of the aluminum alloy sheet is smaller than that defined, Ni content of the aluminum became smaller to be 0.002 Wt %. Therefore, large amount of non-grained portions were left and uniformity was lowered.

Next, discussion will be given for the embodiment of the manufacturing method of the aluminum alloy for printing press.

Embodiment J

For aluminum alloy ingots having chemical composition of example I1 shown in the following Table I-1, similar treatment to those in the embodiment F was performed to obtain the aluminum alloy sheets. The properties of the obtained aluminum alloy sheets were evaluated.

TABLE J-1

| No. | HOMOGENIZATION TREATMENT TEMPERATURE (°C.) | HOT ROLLING START TEMPERATURE (°C.) | MATRIX (Wt %) Fe | Si | Ni |
|---|---|---|---|---|---|
| EXAMPLE | | | | | |
| J1 | 525 | 439 | 0.081 | 0.05 | 0.006 |
| J2 | 594 | 448 | 0.076 | 0.03 | 0.004 |
| J3 | 543 | 411 | 0.078 | 0.04 | 0.005 |
| COMPARATIVE EXAMPLE | | | | | |
| J4 | 488 | 435 | 0.015 | 0.01 | 0.003 |
| J5 | 640 | 443 | 0.213 | 0.10 | 0.012 |
| J6 | 515 | 375 | 0.012 | 0.013 | 0.002 |
| J7 | 579 | 473 | 0.008 | 0.010 | 0.001 |

| No. | GRAINING ABILITY EVALUATION | UNIFORMITY EVALUATION | REMARKS |
|---|---|---|---|
| EXAMPLE | | | |
| J1 | ○ | ○ | |
| J2 | ○ | ○ | |
| J3 | ○ | ○ | |
| COMPARATIVE EXAMPLE | | | |
| J4 | ○ | x | SOAKING LOW TEMPERATURE MATRIX Si; SMALL |
| J5 | x | x | SOAKING HIGH TEMPEATURE MATRIX Fe; LARGE |

TABLE J-1-continued

| | | | |
|---|---|---|---|
| J6 | x | x | HOT ROLLING LOW TEMPERATURE MATRIX Si; LARGE |
| J7 | ○ | x | HOT ROLLING HIGH TEMPERATURE MATRIX Fe; SMALL |

As shown in the foregoing Table J-1, in the examples J1 to J3, both of the non-grained portion evaluation and uniformity evaluation were good.

On the other hand, in the comparative example No. J4, the homogenization treatment temperature is 488° C. which is lower than the temperature defined in the present invention. Therefore, Si content in the aluminum became 0.01 Wt % which is smaller than that defined. Thus, evaluation of uniformity was no good.

In comparative example No. J5, the homogenization treatment temperature is 640° C. which is higher than the temperature range defined by the present invention, the Fe content of the aluminum matrix became 0.213 Wt % which is larger than that of defined. Therefore, large amount of non-grained portion was left. Also, uniformity was no good.

In the comparative example No. J6, the hot rolling start temperature is 375° C. which is lower than the temperature range defined in the present invention. Therefore, Si content in the aluminum matrix became small to be 0.013 Wt %. Thus, fluctuation was caused in the pit size to make uniformity evaluation no good.

In the comparative example No. J7, the hot rolling start temperature is 473° C. which is higher than the temperature range defined in the present invention. Therefore, Fe content in the aluminum matrix became large to be 0.008 Wt %. Thus, uniformity evaluation was no good.

Embodiment K

Aluminum alloy ingots having chemical compositions of examples K1 to K3 and comparative examples K4 to K11 shown in the following Table K-1 was faced to make a thickness of 480 mm. Then, the aluminum alloy ingots were subject homogenization treatment at 595° C. for five hours. Subsequently, hot rolling treatment is performed at 425° C. of rolling start temperature. Thereafter, cold rolling, intermediate annealing, and further cold rolling were performed in order to produce aluminum alloy sheet of 0.3 mm thickness. Si content of the surface portion from the surface of obtained aluminum alloy sheets to the depth of 3 μm was analyzed by cold-cathode discharge mass spectrograph (GD-MS).

TABLE K-1

| | | CHEMICAL COMPOSITION (Wt %) | | | | SURFACE LAYER PORTION | |
|---|---|---|---|---|---|---|---|
| No. | | SI | Fe | Ni | Ti | Si (Wt %) | REMARKS |
| EXAMPLE | K1 | 0.06 | 0.29 | 0.029 | 0.031 | 0.07 | |
| | K2 | 0.12 | 0.45 | 0.008 | 0.047 | 0.18 | |
| | K3 | 0.04 | 0.37 | 0.186 | 0.008 | 0.05 | Ti:QUITE SMALL |
| COMPARATIVE | K4 | 0.19 | 0.32 | 0.012 | 0.031 | 0.12 | Si:LARGE |
| | K5 | 0.07 | 0.16 | 0.046 | 0.022 | 0.07 | Fe:SMALL |
| | K6 | 0.04 | 0.64 | 0.113 | 0.018 | 0.05 | Fe:LARGE |

TABLE K-1-continued

| | | CHEMICAL COMPOSITION (Wt %) | | | | SURFACE LAYER PORTION | |
|---|---|---|---|---|---|---|---|
| No. | | SI | Fe | Ni | Ti | Si (Wt %) | REMARKS |
| EXAMPLE | K7 | 0.06 | 0.26 | 0.003 | 0.011 | 0.06 | Ni:SMALL |
| | K8 | 0.04 | 0.30 | 0.233 | 0.026 | 0.13 | Ni:LARGE |
| | K9 | 0.08 | 0.44 | 0.018 | 0.066 | 0.19 | Ti:LARGE |
| | K10 | 0.03 | 0.53 | 0.030 | 0.021 | 0.03 | SURFACE LAYER Si: SMALL |
| | K11 | 0.06 | 0.32 | 0.045 | 0.013 | 0.23 | SURFACE LAYER Si: LARGE |

Next, for respective aluminum alloy sheets manufactured as set forth above, surface graining treatment was performed in the manner similar to that of embodiment E. The properties was evaluated.

The grained surfaces of respective cut sheets were observed by means of SEM at magnification of 350 and a photomicrograph is taken so that the field of vision becomes 0.02 $mm^2$. On the basis of this photomicrograph, non-grained ratio was derived according to the foregoing equation 3.

On the basis of results of calculation, when the non-grained area being less than or equal to 8.0% is indicated by ○(good), and being more than 8.0% is indicated by X (no good).

The grained surfaces of respective cut sheets were observed by means of SEM and a photomicrograph is taken at a magnification of 500. On the photomicrograph, total 100 cm of lines are drawn to measure sizes of pits below the lines. At this time, when a difference of sizes of the minimum pit and the maximum pit is less than 2 μm, uniformity is evaluated as ⊙ (excellent), is more that 2 μm and less than or equal to 3 μm as ○ (good), and is more than 3 μm, uniformity is evaluated as no good (X).

In the following Table K-2, treatment condition and evaluation in streak, non-grained portion and uniformity are shown. It should be noted that, in each examples and comparative examples, respective evaluation under the treatment condition 1 and that under the condition 2 are the same.

TABLE K-2

| No. | GRAINING ABILITY EVALUATION | UNIFORMITY EVALUATION |
|---|---|---|
| EXAMPLE | | |
| K1 | ○ | ○ |
| K2 | ○ | ⊙ |
| K3 | ○ | ○ |
| COMPARATIVE EXAMPLE | | |
| K4 | x | x |
| K5 | x | x |
| K6 | ○ | x |
| K7 | ○ | x |
| K8 | x | x |
| K9 | ○ | x |
| K10 | ○ | x |
| K11 | x | x |

As shown in the foregoing Table K-2, in the examples Nos. K1 to K3, since contents of respective elements are in the ranges defined in the present invention, both of graining ability evaluation and uniformity evaluation were good.

In the comparative example No. K4, since the Si content 0.19 Wt % is larger than the content defined the present invention. Therefore, Al-Fe type intermetallic compound lacked to make initial pit insufficient. Large grain size compound was formed and fluctuation of pit size was caused.

In the comparative example No. K5, since the Fe content 0.16 Wt % is smaller than that defined, formation of electrically surface graining pits lacks to cause non-grained portion in the electrolytically grained surface. On the other hand, in the comparative example No. K6, Fe content 0.64 Wt % is larger than that defined, large grain size compound is formed and fluctuation of pit size was caused to make uniformity no good.

In the comparative example No. K7, since the Ni content 0.003 Wt % is smaller than that defined, the uniformity was degraded. On the other hand, in the comparative example No. K8, the Ni content 0.233 Wt % larger than that defined, large grain size compound was formed and uniformity became no good.

On the other hand, in the comparative example No. K9, since the Ti content 0.066 Wt % is larger than that defined, large grain size compound was formed, pit became deeper and in strip form and uniformity became no good.

In the comparative example No. K10, Si content 0.03 Wt % in the surface layer of aluminum alloy sheet is smaller than that defined, surface concentration amount lacks to cause degradation of uniformity. On the other hand, in the comparative example No. K11, Si content 0.23 Wt % in the surface layer is larger than that defined, excessive etching was caused and fluctuation of pit size was caused to make uniformity evaluation no good.

Embodiment L

Aluminum alloy ingots (examples Nos. L1 to L6 and comparative examples Nos. L7 to L16) having chemical composition shown in the following Table L-1 was faced to make a thickness of 470 mm. Then, the aluminum alloy ingots were subject homogenization treatment at 590° C. for four hours. Subsequently, hot rolling treatment is performed at 430° C. of rolling start temperature. Thereafter, cold rolling, intermediate annealing, and further cold rolling were performed in order to produce aluminum alloy sheet of 0.3 mm thickness.

TABLE L-1

| | | CHEMICAL COMPOSITION (Wt %) | | | | |
|---|---|---|---|---|---|---|
| | No. | Si | Fe | Ti | Ni | REMARKS |
| EXAMPLE | L1 | 0.03 | 0.30 | 0.01 | 0.030 | |
| | L2 | 0.03 | 0.30 | 0.01 | 0.100 | |
| | L3 | 0.10 | 0.31 | 0.02 | 0.020 | |
| | L4 | 0.05 | 0.55 | 0.04 | 0.033 | |
| | L5 | 0.05 | 0.25 | 0.03 | 0.052 | |
| | L6 | 0.03 | 0.25 | 0.01 | 0.010 | |
| COMPARATIVE EXAMPLE | L7 | 0.03 | 0.30 | 0.01 | 0.004 | Ni:SMALL |
| | L8 | 0.03 | 0.30 | 0.01 | 0.300 | Ni:LARGE |
| | L9 | 0.20 | 0.30 | 0.01 | 0.05 | Si:LARGE |
| | L10 | 0.01 | 0.32 | 0.01 | 0.05 | Si:SMALL |
| | L11 | 0.03 | 0.15 | 0.01 | 0.05 | Fe:SMALL |
| | L12 | 0.03 | 0.70 | 0.01 | 0.07 | Fe:LARGE |
| | L13 | 0.03 | 0.30 | 0.003 | 0.03 | Ti:SMALL |
| | L14 | 0.03 | 0.30 | 0.06 | 0.10 | Ti:LARGE |

TABLE L-1-continued

| | CHEMICAL COMPOSITION (Wt %) | | | | |
|---|---|---|---|---|---|
| No. | Si | Fe | Ti | Ni | REMARKS |
| L15 | 0.15 | 0.60 | 0.01 | 0.20 | |
| L16 | 0.03 | 0.20 | 0.01 | 0.01 | |

Next, for respective aluminum alloy sheet produced as set forth above, degreasing and neutralization washing were performed by treatment conditions A to E shown in the following Table L-2. Thereafter, alternate current electrolytic surface graining treatment was performed. Then, desmutting treatment for removing oxide and so forth formed by electrolytic treatment was performed. After completion of desmutting treatment, respective aluminum alloy sheet were washed and dried. Then, the aluminum alloy sheets were cut into a given size as samples. In the treatment condition E, as mechanical treatment, mechanical graining was performed for the aluminum alloy sheets in a suspension of permisestone and water using rotaed nylon brush. It should be noted that in the following Table L-2, 1 $dm^2$ is 0.01 $m^2$.

Polarization resistance of respective aluminum alloy sheets were measured during alternate current electrolytic surface graining treatment under the treatment conditions A to E. Potentials with reference to current (current density) of respective cycle of respective electrolytic surface graining treatment and saturated calomel electrode were measured. Among obtained potential-current curve, from potential-current curve at 1st cycle and 500th cycle, polarization resistance are calculated. Obtained polarized resistance under respective treatment conditions are shown in the following Table L-3.

TABLE L-2

| TREATMENT | | TREATMENT CONDITION A |
|---|---|---|
| MECHANICAL TREATMENT | | NON |
| DEGREASING | SOLUTION | 10% SODIUM HYDROXIDE |
| | TEMPERATURE | 40° C. |
| | TIME | 10 SEC. |
| NEUTRIZATION WASHING | SOLUTION | 10% NITRIC ACID |
| | TEMPERATURE | 20° C. |
| | TIME | 30 SEC. |
| ALTERNATE CURRENT SURFACE ROUGHENING TREATMENT | SOLUTION | 1.8% HYDROCHLORIC ACID |
| | TEMPERATURE | 25° C. |
| | FREQUENCY | 50 Hz |
| | CURRENT DENSIRY | 60 A/$dm^2$ |
| | TIME | 30 SEC. |
| DESMUTTING TREATMENT | SOLUTION | 5% SODIUM HYDROXIDE |
| | TEMPERATURE | 60° C. |
| | TIME | 10 SEC. |
| TREATMENT | | TREATMENT CONDITION B |
| MECHANICAL TREATMENT | | NON |
| DEGREASING | SOLUTION | 10% SODIUM HYDROXIDE |
| | TEMPERATURE | 40° C. |
| | TIME | 10 SEC. |
| NEUTRIZATION WASHING | SOLUTION | 10% NITRIC ACID |
| | TEMPERATURE | 20° C. |
| | TIME | 30 SEC. |
| ALTERNATE CURRENT SURFACE | SOLUTION | 1.8% CHYDROCHLORIC ACID |
| | TEMPERATURE | 25° C. |

TABLE L-2-continued

| | | |
|---|---|---|
| ROUGHENING TREATMENT | FREQUENCY | 50 Hz |
| | CURRENT DENSIRY | 40 A/dm$^2$ |
| | TIME | 45 SEC. |
| DESMUTTING TREATMENT | SOLUTION | 5% SODIUM HYDROXIDE |
| | TEMPERATURE | 60° C. |
| | TIME | 10 SEC. |

| TREATMENT | TREATMENT CONDITION C | |
|---|---|---|
| MECHANICAL TREATMENT | | NON |
| DEGREASING | SOLUTION | 10% SODIUM HYDROXIDE |
| | TEMPERATURE | 50° C. |
| | TIME | 30 SEC. |
| NEUTRIZATION WASHING | SOLUTION | 20% NITRIC ACID |
| | TEMPERATURE | 25° C. |
| | TIME | 30 SEC. |
| ALTERNATE CURRENT SURFACE ROUGHENING TREATMENT | SOLUTION | 1.0% NITRIC ACID |
| | TEMPERATURE | 25° C. |
| | FREQUENCY | 60 Hz |
| | CURRENT DENSIRY | 50 A/dm$^2$ |
| | TIME | 30 SEC. |
| DESMUTTING TREATMENT | SOLUTION | 10% SODIUM HYDROXIDE |
| | TEMPERATURE | 40° C. |
| | TIME | 10 SEC. |

| TREATMENT | TREATMENT CONDITION D | |
|---|---|---|
| MECHANICAL TREATMENT | | NON |
| DEGREASING | SOLUTION | 10% SODIUM HYDROXIDE |
| | TEMPERATURE | 50° C. |
| | TIME | 30 SEC. |
| NEUTRIZATION WASHING | SOLUTION | 20% NITRIC ACID |
| | TEMPERATURE | 25° C. |
| | TIME | 30 SEC. |
| ALTERNATE CURRENT SURFACE ROUGHENING TREATMENT | SOLUTION | 1.0% NITRIC ACID |
| | TEMPERATURE | 25° C. |
| | FREQUENCY | 60 Hz |
| | CURRENT DENSIRY | 80 A/dm$^2$ |
| | TIME | 20 SEC. |
| DESMUTTING TREATMENT | SOLUTION | 10% SODIUM HYDROXIDE |
| | TEMPERATURE | 40° C. |
| | TIME | 10 SEC. |

| TREATMENT | REATMENT CONDITION E | |
|---|---|---|
| MECHANICAL TREATMENT | | DONE |
| DEGREASING | SOLUTION | 10% SODIUM HYDROXIDE |
| | TEMPERATURE | 50° C. |
| | TIME | 30 SEC. |
| NEUTRIZATION WASHING | SOLUTION | 20% NITRIC ACID |
| | TEMPERATURE | 25° C. |
| | TIME | 30 SEC. |
| ALTERNATE CURRENT SURFACE ROUGHENING TREATMENT | SOLUTION | 1.0% NITRIC ACID |
| | TEMPERATURE | 25° C. |
| | FREQUENCY | 60 Hz |
| | CURRENT DENSIRY | 50 A/dm$^2$ |
| | TIME | 30 SEC. |
| DESMUTTING TREATMENT | SOLUTION | 10% SODIUM HYDROXIDE |
| | TEMPERATURE | 40° C. |
| | TIME | 10 SEC. |

TABLE L-3

| | No. | POLARIZATION RESISTANCE AT 1st CYCLE ($\Omega \cdot cm^2$) CONDITION A | CONDITION B | CONDITION C | CONDITION D | CONDITION E | REMARKS |
|---|---|---|---|---|---|---|---|
| EXAMPLE | L1 | 7.1 | 6.5 | 7.3 | 5.8 | 7.2 | |
| | L2 | 5.1 | 4.7 | 5.4 | 4.6 | 5.4 | |
| | L3 | 10.1 | 9.8 | 10.6 | 9.1 | 10.6 | |
| | L4 | 6.9 | 6.4 | 7.1 | 5.5 | 6.7 | |
| | L5 | 5.8 | 5.2 | 6.3 | 4.9 | 6.0 | |
| | L6 | 12.3 | 11.8 | 12.1 | 9.1 | 12.3 | |
| COMPARATIVE EXAMPLE | L7 | 16.3 | 15.4 | 16.0 | 14.9 | 16.7 | |
| | L8 | 4.3 | 3.8 | 4.5 | 4.1 | 3.7 | CONDITION B,E:SMALL |
| | L9 | 16.9 | 15.3 | 16.5 | 15.7 | 16.1 | |
| | L10 | 5.3 | 4.6 | 5.1 | 4.8 | 5.6 | |
| | L11 | 17.1 | 15.8 | 16.9 | 15.9 | 17.4 | CONDITION A,E :LARGE |
| | L12 | 4.0 | 3.2 | 3.8 | 3.3 | 3.9 | CONDITION B,C,D,E: SMALL |
| | L13 | 6.9 | 6.3 | 7.0 | 6.7 | 7.3 | |
| | L14 | 7.4 | 6.9 | 8.1 | 7.1 | 7.7 | |
| | L15 | 3.9 | 3.1 | 3.8 | 2.8 | 3.6 | CONDITION A TO E: SMALL |
| | L16 | 17.5 | 17.1 | 17.8 | 17.1 | 18.0 | CONDITION A TO E: LARGE |

TABLE L-3-continued

| | No. | POLARIZATION RESISTANCE AT 500th CYCLE ($\Omega \cdot cm^2$) CONDITION A | CONDITION B | CONDITION C | CONDITION D | CONDITION E | REMARKS |
|---|---|---|---|---|---|---|---|
| EXAMPLE | L1 | 7.5 | 6.8 | 7.4 | 5.6 | 7.3 | |
| | L2 | 5.1 | 4.8 | 5.1 | 4.9 | 5.7 | |
| | L3 | 10.3 | 9.6 | 10.9 | 9.4 | 10.1 | |
| | L4 | 6.7 | 6.5 | 7.4 | 5.1 | 6.5 | |
| | L5 | 5.9 | 5.4 | 6.5 | 4.2 | 6.8 | |
| | L6 | 12.1 | 11.4 | 12.3 | 9.6 | 12.5 | |
| COMPARATIVE EXAMPLE | L7 | 16.1 | 15.3 | 16.5 | 14.7 | 16.9 | |
| | L8 | 4.0 | 3.8 | 4.5 | 4.4 | 3.2 | CONDITION B,E:SMALL |
| | L9 | 16.1 | 15.6 | 16.3 | 15.5 | 16.1 | |
| | L10 | 5.3 | 4.1 | 5.3 | 4.7 | 5.9 | |
| | L11 | 17.8 | 15.4 | 16.7 | 15.2 | 17.1 | CONDITION A,E:LARGE |
| | L12 | 4.6 | 3.7 | 3.5 | 3.4 | 3.9 | CONDITION B,C,D,E: SMALL |
| | L13 | 6.1 | 6.3 | 7.5 | 6.7 | 7.9 | |
| | L14 | 7.4 | 6.8 | 8.6 | 7.4 | 7.2 | |
| | L15 | 3.2 | 3.1 | 3.8 | 2.9 | 3.5 | CONDITION A TO E:SMALL |
| | L16 | 17.5 | 17.1 | 17.2 | 17.1 | 18.1 | CONDITION A TO E:LARGE |

Non-grained portion and uniformity of samples were evaluated by the following tests. Methods for non-grained portion evaluation and uniformity evaluation were the same as those in the embodiment E.

In the following Table L-4, evaluations of non-grained portion and uniformity with respect to respective treatment conditions.

TABLE L-4

| | No. | GRAINING ABILITY EVALUATION A | B | C | D | E | UNIFORMITY EVALUATION A | B | C | D | E |
|---|---|---|---|---|---|---|---|---|---|---|---|
| EXAMPLE | L1 | ○ | ○ | ○ | ○ | ○ | ○ | ○ | ○ | ○ | ○ |
| | L2 | ○ | ○ | ○ | ○ | ○ | ○ | ○ | ○ | ○ | ○ |
| | L3 | ○ | ○ | ○ | ○ | ○ | ○ | ○ | ○ | ○ | ○ |
| | L4 | ○ | ○ | ○ | ○ | ○ | ○ | ○ | ○ | ○ | ○ |
| | L5 | ○ | ○ | ○ | ○ | ○ | ○ | ○ | ○ | ○ | ○ |
| | L6 | ○ | ○ | ○ | ○ | ○ | ○ | ○ | ○ | ○ | ○ |
| COMPARATIVE EXAMPLE | L7 | X | X | X | X | X | X | X | X | X | X |
| | L8 | ○ | ○ | ○ | ○ | ○ | X | X | X | X | X |
| | L9 | X | X | X | X | X | X | X | X | X | X |
| | L10 | ○ | ○ | ○ | ○ | ○ | X | X | X | X | X |
| | L11 | X | X | X | X | X | X | X | X | X | X |
| | L12 | ○ | ○ | ○ | ○ | ○ | X | X | X | X | X |
| | L13 | ○ | ○ | ○ | ○ | ○ | X | X | X | X | X |
| | L14 | ○ | ○ | ○ | ○ | ○ | X | X | X | X | X |
| | L15 | ○ | ○ | ○ | ○ | ○ | X | X | X | X | X |
| | L16 | X | X | X | X | X | X | X | X | X | X |

As shown in the foregoing Table L-4, in the examples Nos. L1 to L6, contents of each elements are within the range defined by the present invention. Also, respective polarization resistance at 1st and 500th cycles are within the range defined by the present invention, graining ability evaluation and uniformity evaluation were both good.

On the other hand, in the comparative example L7, Ni content 0.004 Wt % of the aluminum alloy sheet is smaller than the range defined by the present invention, generating ability of the initial pit was not sufficient, and chemical-etch ability became insufficient. Therefore, large number of non-grained portions were left. Also, fluctuation of pit size is caused and uniformity was degraded.

In the comparative example No. L8, Ni content 0.3 Wt % of the aluminum alloy sheet is larger. On the other hand, the polarization resistance of 1st cycle under treatment conditions B and E were 3.8 and 3.7 $\Omega cm^2$ which were smaller, respectively. The polarization resistance of 500th cycle under treatment conditions B and E were 3.8 and 3.2 $\Omega cm^2$which were large, respectively. By these factors, chemical-etch ability was excessively promoted and uniformity became no good.

In the comparative example No. L9, Si content 0.03 Wt % is large. Thus, large grain size compound was formed to make electrolytically grained surface became un-uniform. Thus, uniformity evaluation became no good. Also, non-grained portion was caused.

In the comparative example No. L10, Si content 0.01 Wt % is small. Formation of initial pit became insufficient, and uniformity of pit was degraded.

In the comparative example No. L11, Fe content 0.15 Wt % is small to cause lack of Al-Fe type intermetallic compound, and formation of initial pit during electrolytic surface graining treatment became insufficient. Also, polarization resistance at 1st cycle under the treatment conditions A and E were 17.1 and 17.4 $\Omega cm^2$which is large, respectively, at 500th cycle under the treatment conditions A and E were 17.8 and 17.1 $\Omega cm^2$ which are large. By these factors, non-grained portion was caused and uniformity evaluation was no good.

In the comparative example No. L12, Fe content 0.70 Wt % is large, large grain size compound is formed. On the other hand, polarization resistance at 1st cycle under the treatment condition B to E were 3.2, 3.8, 3.3 and 3.9 $\Omega cm^2$ respectively which were small, and polarization resistance at 500th cycle under the treatment condition B to E were 3.7, 3.5, 3.4 and 3.9 $\Omega cm^2$ respectively which were small. By these factors, fluctuation of pit size is caused and uniformity evaluation became no good.

In the comparative example No. L13, Ti content 0.003 Wt % is small. Thus, refining of crystal grain became insufficient and uniformity evaluation became no good.

In the comparative example No. L14, Ti content 0.06 Wt % is large, un-uniform pits were formed.

In the comparative example No. L15, polarization resistance at 1st cycle under the treatment condition A to E were 3.9, 3.1, 3.8, 2.8 and 3.6 $\Omega cm^2$ respectively which were small, and polarization resistance at 500th cycle under the treatment condition A to E were 3.2, 3.1, 3.8, 2.9 and 3.5 $\Omega cm^2$ respectively which were small. Fluctuation of pit size is caused, and uniformity evaluation was no good.

In the comparative example No. L16, polarization resistance at 1st cycle under the treatment conditions A to E were 17.5, 17.1, 17.8, 17.1 and 18.0 $\Omega cm^2$ respectively which were large, and polarization resistance at 500th cycle under the treatment conditions A to E were 17.5, 17.1, 17.2, 17.1 and 18.1 $\Omega cm^2$ respectively which were large. By these factors, non-grained portion was caused. Also, fluctuation of pit size is caused.

Next, discussion will be caused for embodiment of manufacturing treatment of the aluminum alloy sheet of printing plate.

Embodiment M

Aluminum alloy ingots having chemical composition of example L1 shown in the foregoing Table L-1 was faced to make a thickness of 470 mm. Then, the homogenization treatment, hot rolling treatment, cold rolling, intermediate annealing, and further cold rolling were performed in the following conditions shown in Table M-1, and to produce aluminum alloy sheet of 0.3 mm thickness (examples Nos. M1 to M3 and comparative examples Nos. M4 to M7).

Next, for each aluminum alloy sheet produced as set forth above, degreasing and neutralization washing, alternate current electrolytic surface graining treatment and desmutting treatment were performed under the conditions shown in Table L-2. After completion of desmutting treatment, respective aluminum alloy sheets were washed and dried. Polarization resistance of respective aluminum alloy sheets were measured 300th cycle, polarization resistance are calculated. With the similar testing method and evaluation reference to the embodiment L, non-grained portion and uniformity were evaluated. It should be noted that when good under all of the treatment conditions A to E, is evaluated as ○, and when evaluation was no good under at least one conditions A to E, is evaluated as X. Obtained result is shown as shown in the following Table M-1.

TABLE M-1

| | | HOMOGENIZATION TREATMENT | HOT ROLLING START | POLARIZATION RESISTANCE AT 300th ($\Omega \cdot cm^2$) | | | | |
|---|---|---|---|---|---|---|---|---|
| | No. | TEMPERATURE (°C.) | TEMPERATURE (°C.) | CONDITION A | CONDITION B | CONDITION C | CONDITION D | CONDITION E |
| EXA. | M1 | 525 | 439 | 6.3 | 5.5 | 6.3 | 5.2 | 6.8 |
| | M2 | 594 | 448 | 7.6 | 6.7 | 7.8 | 6.4 | 8.1 |
| | M3 | 543 | 411 | 10.3 | 8.1 | 11.4 | 8.4 | 10.4 |
| COM. | M4 | 488 | 435 | 4.1 | 3.7 | 3.9 | 3.6 | 4.2 |
| EXA. | M5 | 640 | 443 | 17.4 | 16.1 | 16.8 | 16.4 | 17.3 |
| | M6 | 515 | 375 | 16.4 | 15.8 | 17.1 | 14.7 | 16.9 |
| | M7 | 579 | 473 | 4.7 | 4.0 | 4.5 | 3.9 | 4.1 |

| | No. | GRAINING ABILITY EVALUATION | UNIFORMITY EVALUATION | REMARKS |
|---|---|---|---|---|
| EXAMPLE | M1 | ○ | ○ | |
| | M2 | ○ | ○ | |
| | M3 | ○ | ○ | |
| COMPARATIVE EXAMPLE | M4 | ○ | X | SOAKING LOW TEMPERATURE CONDITION B,C,D:SMALL |
| | M5 | X | X | SOAKING HIGH TEMPERATURE, CONDITION A,E :LARGE |
| | M6 | X | X | HOT ROLLING LOW TEMPERATURE, CONDITION C:LARGE |
| | M7 | ○ | X | HOT ROLLING HIGH TEMPERATURE, CONDITION D:SMALL |

As shown in the Table M-1, in the examples Nos. M1 to M3, evaluations for graining ability and uniformity were all good.

On the other hand, in the comparative example No. M4, since the homogenization treatment temperature is 488° C. which is lower than the temperature defined in the present invention, polarization resistance under the treatment conditions B, C and D were respectively 3.7, 3.9 and 3.6 $\Omega cm^2$, which were small. On the other hand, in the comparative example No. M5, since the homogenization treatment temperature is 640° C. which is higher than the temperature range defined by the present invention, polarization resistance under the treatment conditions A and E were respectively 17.4 and 17.3 $\Omega cm^2$, which were large to cause non-grained portion. Also, fluctuation of pit size was caused.

In the comparative example No. M6, since the hot rolling start temperature is 375° C. which is lower than the temperature range defined in the present invention, the polarization resistance under the treatment condition C became 17.1 $\Omega cm^2$ to cause non-grained portion. Also, fluctuation of pit size was caused. In the comparative example No. M7, the hot rolling start temperature is 473° C. which is higher than the temperature range defined in the present invention, the polarization resistance under the treatment condition D became 3.9 $\Omega cm^2$ to cause fluctuation of pit size. Also, uniformity evaluation was no good.

Embodiment N

At first, for respective aluminum alloy ingots having various chemical compositions shown in the following Table N-1, aluminum alloy sheets were produced in the manner similar to the foregoing embodiment E. With respect to obtained aluminum alloy sheets, test pieces are prepared. With respect to respective test pieces, graining ability and uniformity of grained surfaces were evaluated.

Also, the prepared test pieces are subject degreasing and neutralization under the conditions shown in the foregoing Table A-2, and thereafter, impedance was measured under condition in the following Table N-2. Then, maximum value of real number axis component of the impedance trace was calculated. In the shown embodiment, as measured value of impedance, electrochemical impedance measuring device HZ-1A (Hokuto Denko K.K.) was used. Evaluation reference for graining ability and uniformity of grained surface are also shown in the following Table N-1.

TABLE N-1

| | No | CHEMICAL COMPOSITION (Wt %) Si | Fe | Ti | Ni | MAXIMUM VALUE OF REAL NUMBER AXIS COMPONENT (Ω) | EVALUATION RESULT GRAINING ABILITY | UNIFORMITY |
|---|---|---|---|---|---|---|---|---|
| EXAMPLE | N1 | 0.03 | 0.30 | 0.01 | 0.030 | 460 | ○ | ○ |
| | N2 | 0.03 | 0.30 | 0.01 | 0.100 | 220 | ○ | ○ |
| | N3 | 0.10 | 0.31 | 0.02 | 0.020 | 650 | ○ | ○ |
| | N4 | 0.05 | 0.55 | 0.04 | 0.033 | 560 | ○ | ○ |
| | N5 | 0.05 | 0.25 | 0.03 | 0.052 | 300 | ○ | ○ |
| | N6 | 0.03 | 0.25 | 0.01 | 0.010 | 780 | ○ | ○ |
| EXAMPLE COMPARATIVE | N7 | 0.03 | 0.30 | 0.01 | 0.004 | 800 | X | X |
| | N8 | 0.03 | 0.30 | 0.01 | 0.300 | 200 | ○ | X |
| | N9 | 0.20 | 0.30 | 0.01 | 0.05 | 700 | X | X |
| | N10 | 0.01 | 0.32 | 0.003 | 0.05 | 400 | ○ | X |
| | N11 | 0.03 | 0.15 | 0.01 | 0.05 | 900 | X | X |
| | N12 | 0.03 | 0.70 | 0.01 | 0.07 | 200 | ○ | X |
| | N13 | 0.03 | 0.30 | 0.003 | 0.03 | 800 | ○ | X |
| | N14 | 0.03 | 0.30 | 0.06 | 0.10 | 600 | ○ | X |
| | N15 | 0.15 | 0.60 | 0.01 | 0.20 | 80 | ○ | X |
| | N16 | 0.03 | 0.20 | 0.01 | 0.01 | 1100 | X | X |

TABLE N-2

| TREATMENT STEP | TREATMENT CONDITION | |
|---|---|---|
| IMPEDANCE MEASUREMENT | SOLUTION | 1.8% citric ACID |
| | TEMPERATURE | 25° C. |
| | FREQUENCY | 100000~1 Hz |
| | AMPLITUDE | 10 mV |

As shown in the foregoing Table N-1, the examples Nos. N1 to N6 has contents of respective elements and maximum values of real number axis components of the impedance traces fall within the range defined in the present invention, all achieved good graining ability and uniformity. It should be noted that interface impedance of examples N1, N3, N4 and N6 are shown as impedance traces 1, 3, 2 and 4 in FIG. 2. The maximum value of the real number axis component of the example No. N1 is derived from the impedance trace 1. The maximum value of the real number axis component of the example No. N3 is derived from the impedance trace 3. The maximum value of the real number axis component of the example No. N4 is derived from the impedance trace 2. The maximum value of the real number axis component of the example No. N6 is derived from the impedance trace 4.

On the other hand, the comparative example No. N7 has Ni content less the lower limit of the range defined by the present invention. Therefore, formation of initial pit and chemical-etch ability became insufficient. Therefore, large amount of non-grained portion were left, fluctuation of pit size is caused and uniformity is degraded. On the other hand, the comparative example N8 has Ni content exceeding upper limit of the range defined by the present invention. Therefore, chemical-etch ability is excessively promoted to make uniformity no good. The comparative example No. N9 has Si content exceeding the upper limit of the range defined by the present invention. Then, large grain size compound was formed to make the electrolytically grained surface un-uniform to make graining ability and uniformity no good.

The comparative example No. N10 has Si content less than the lower limit of the range defined by the present invention. Thus, formation of initial bit became insufficient. On the other hand, since Ti content is less than the lower limit of the range defined by the present invention, refining of the cast structure became insufficient to make uniformity no good. The comparative example No. N11 has Fe content less than the lower limit of the range defined by the present invention. Therefore, initial pit lacks during electrolytic surface graining treatment to make evaluation of graining ability and uniformity no good.

On the other hand, the comparative example No. N12 has Fe content exceeding the upper limit of the range defined by the present invention to form large grain size compound to make electrolytically grained surface un-uniform. The comparative example No. N13 has Ti content less than the lower limit of the range defined by the present invention to make refining of crystal grain insufficient and un-uniform pits are formed to make uniformity no good. The comparative example No. N14 has Ti content exceeding the upper limit of the range defined by the present invention to form large grain size compound to make pit size un-uniform. Thus, uniformity became no good.

Also, the maximum value of the real number axis component of the impedance trace is less than the lower limit of the range defined by the present invention, uniformity of pit became no good. The comparative example No. N16 has the maximum value of the real number axis component of the impedance trace is exceeding the upper limit of the range defined by the present invention, to leave non-grained portion. Thus, graining ability and uniformity were no good.

Embodiment O

Next, discussion will be given for the embodiment of the manufacturing treatment of the aluminum alloy sheet for printing plate according to the present invention, with comparing with the comparative examples.

Aluminum alloy ingots having chemical composition of the foregoing embodiment N1 was faced to make a thickness of 470 mm. Then, the homogenization treatment, hot rolling treatment, cold rolling, intermediate annealing, and further cold rolling were performed in the following Table O-1, and to produce aluminum alloy sheet of 0.3 mm thickness.

Subsequently, with respect to the obtained aluminum alloy sheet, under the similar condition to the examples Nos. N1 to N6 and comparative examples Nos. N7 to N16, graining ability and uniformity of grained surface were evaluated. Also, maximum value of the real axis number component of the impedance trace was calculated. The results of evaluation is shown in the following Table O-1.

TABLE O-1

| | No | HOMOGENIZATION TREATMENT TEMPERATURE (°C.) | HOT ROLLING START TEMPERATURE (°C.) | MAXIMUM VALUE OF REAL NUMBER AXIS (Ω) | EVALUATION RESULT GRAINING ABILITY | EVALUATION RESULT UNIFORMITY |
|---|---|---|---|---|---|---|
| EXAMPLE | O1 | 525 | 439 | 400 | ○ | ○ |
| | O2 | 594 | 448 | 600 | ○ | ○ |
| | O3 | 543 | 411 | 300 | ○ | ○ |
| COMPARATIVE EXAMPLE | O4 | 488 | 435 | 70 | ○ | X |
| | O5 | 640 | 443 | 1200 | X | X |
| | O6 | 515 | 375 | 1300 | X | X |
| | O7 | 579 | 473 | 90 | ○ | X |

As shown in the foregoing Table O-1, homogenization treatment temperature and hot rolling start temperature of the examples Nos. O1 to O3 are both within the range defined by the present invention, and also the maximum values of the real number axis component of the impedance traces are within the range defined by the present invention. Thus, graining ability and uniformity were good.

On the other hand, the homogenization treatment temperature of the comparative example No. O4 is lower than the lower limit of the range defined by the present invention, and the maximum value of the real number axis component of the impedance trace is less than 100Ω, uniformity was no good. The homogenization treatment temperature of the comparative example No. O5 is higher than the upper limit of the range defined by the present invention, and the maximum value of the real number axis component of the impedance trace exceeds than 1000Ω, graining ability and uniformity were lowered.

On the other hand, the hot rolling start temperature of the comparative example No. O6 is lower than the lower limit of the range defined by the present invention, and the maximum value of the real number axis component of the impedance trace is less than 100Ω, graining ability and uniformity were lowered. The hot rolling start temperature of the comparative example No. O7 is higher than the upper limit of the range defined by the present invention, and the maximum value of the real number axis component of the impedance trace is less than 100Ω, uniformity was no good.

Embodiment P

At first, for the aluminum alloy ingots having various chemical compositions shown in the following Tables P-1, the aluminum alloy sheets are produced in the similar manner to the embodiment O. The properties were evaluated.

On the other hand, binding energy distribution of the region up to 5 μm depth from the surfaces of each sample after desmutting treatment was measured by X-ray photoelectron spectroscopy method, and peak width at half height between 530 to 536 eV was calculated. In the shown embodiment, as measuring device of binding energy distribution, PHI5400 (produced by Albackfy) was used.

Furthermore, each sample after desmutting treatment was washed and dried, and then cut into a given size to prepare test piece. With respect to each of the test pieces, graining ability and uniformity were evaluated. The evaluation reference of the graining ability and the uniformity of the grained surface are similar to those of the embodiment M.

TABLE P-1

| | No | CHEMICAL COMPOSITION (Wt %) Si | Fe | Ti | Ni | PEAK WIDTH AT HALF HEIGHT (Ω) 0.025 μm | 0.05 μm | EVALUATION RESULT GRAINING ABILITY | UNIFORMITY |
|---|---|---|---|---|---|---|---|---|---|
| EXAMPLE | P1 | 0.03 | 0.30 | 0.01 | 0.030 | 3.1 | 2.2 | ○ | ○ |
| | P2 | 0.03 | 0.30 | 0.01 | 0.100 | 3.5 | 2.5 | ○ | ○ |
| | P3 | 0.10 | 0.31 | 0.02 | 0.020 | 4.9 | 4.5 | ○ | ○ |
| | P4 | 0.05 | 0.55 | 0.04 | 0.033 | 3.5 | 3.2 | ○ | ○ |
| | P5 | 0.05 | 0.25 | 0.03 | 0.052 | 3.0 | 2.7 | ○ | ○ |
| | P6 | 0.03 | 0.25 | 0.01 | 0.010 | 4.8 | 3.6 | ○ | ○ |
| COMPARATIVE EXAMPLE | P7 | 0.03 | 0.30 | 0.01 | 0.004 | 4.7 | 4.0 | X | X |
| | P8 | 0.03 | 0.30 | 0.01 | 0.300 | 2.8 | 2.1 | ○ | X |
| | P9 | 0.20 | 0.30 | 0.01 | 0.05 | 4.3 | 3.5 | X | X |
| | P10 | 0.01 | 0.32 | 0.003 | 0.05 | 3.4 | 2.2 | ○ | X |
| | P11 | 0.03 | 0.15 | 0.01 | 0.05 | 4.9 | 4.5 | X | X |
| | P12 | 0.03 | 0.70 | 0.01 | 0.07 | 4.0 | 2.8 | ○ | X |
| | P13 | 0.03 | 0.30 | 0.003 | 0.03 | 4.4 | 4.1 | ○ | X |
| | P14 | 0.03 | 0.30 | 0.06 | 0.10 | 3.6 | 3.0 | ○ | X |
| | P15 | 0.15 | 0.60 | 0.01 | 0.20 | 2.3 | 1.8 | ○ | X |
| | P16 | 0.03 | 0.20 | 0.01 | 0.01 | 5.3 | 4.1 | X | X |

As shown in the foregoing Table P-1, the examples Nos. P1 to P6 have element contents and peak widths at half height falling within the ranges defined by the present invention, both of the graining ability and uniformity were good.

On the other hand, the comparative example No. P7 has Ni content less than the lower limit of the range defined in the present invention, both of initial pit and the chemical-etch ability were insufficient. Therefore, large amount of non-grained portion are left, and pit size was fluctuated to cause degradation of the uniformity. The comparative example No. P8 has Ni content exceeding the upper limit of the range defined in the present invention, to excessively promote chemical-etch ability to make uniformity no good. The comparative example No. P9 has Si content exceeding the upper limit of the range defined in the present invention, to form large grain size compound to make electrolytically grained surface un-uniform. Thus, graining ability and uniformity were no good.

The comparative example No. P10 has Si content is less than the lower limit of the range defined in the present invention, initial pit became insufficient. Also, since Ti content is less than the lower limit of the range defined in the present invention, refining of cast structure became insufficient. By this uniformity evaluation became no good. The comparative example No. P11 has Fe content less than the lower limit of the range defined in the present invention, to lack initial bit during electrolytic surface graining treatment. Thus, graining ability and uniformity were no good.

The comparative example No. P12 has Fe content exceeding the upper limit of the range defined in the present invention, to make electrolytically grained surface un-uniform. The comparative example No. P13 has Ti content less than the lower limit of the range defined in the present invention, refining of cast structure became insufficient. By this uniformity evaluation became no good. The comparative example No. P14 has Ti content exceeding the upper limit of the range defined in the present invention, to form large grain size compound. Also pit size became un-uniform to make uniformity no good.

Also, peak width at half height is less than the lower limit of the range defined by the present invention to make pit uniformity no good. The comparative example No. P16 has peak width at half height exceeding the upper limit of the range defined in the present invention, non-grained portion was left to make graining ability and uniformity no good.

Next, in order to compare variation of hydration from the surface of the aluminum alloy sheet to the inside, the binding energy distribution of the region from the surface of the aluminum alloy sheet of the example No. P1 and comparative examples Nos. P15 and P16, up to 5 μm depth was measured by X-ray photoelectron spectroscopy method, and the peak width at half height at each position was calculated.

Figure 3:
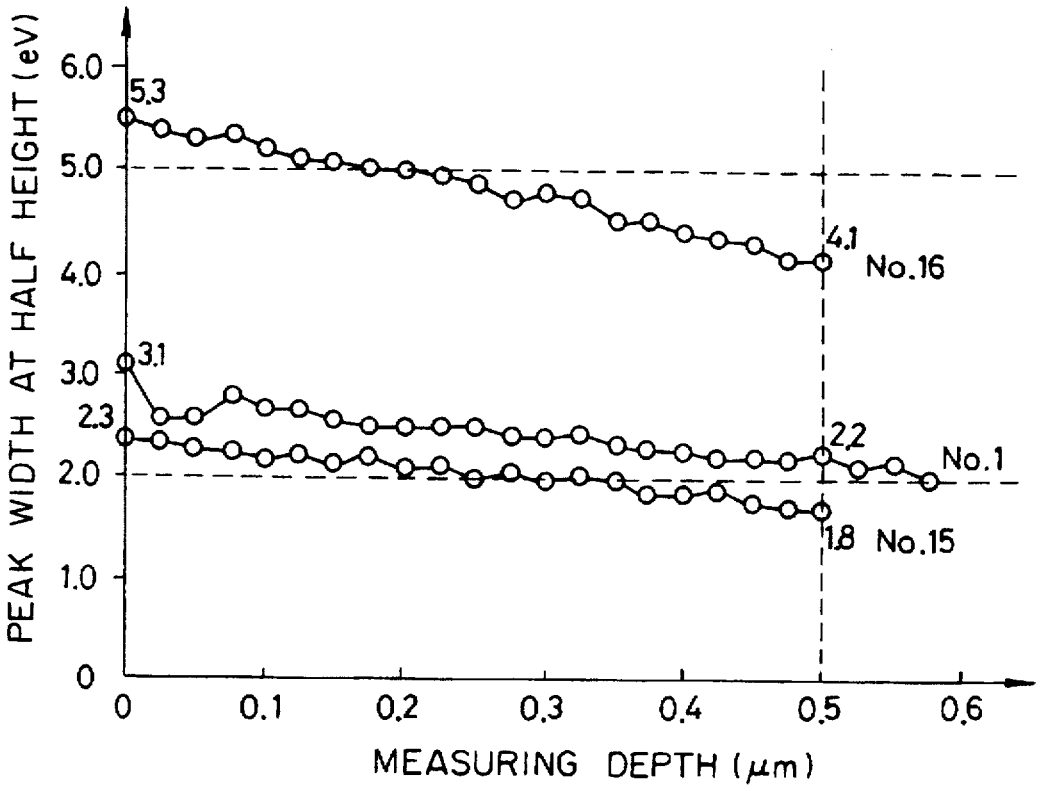
FIG. 3 is a graph showing a relationship between a peak width at half height and a measured depth.

FIG. 3 is a graph showing a relationship between the peak width at half height at the vertical axis and measuring depth at horizontal axis. It should be noted that No. in FIG. 3 correspond to No. of the example and comparative example. The unit of the value in FIG. 3 is the peak width at half height (eV). As shown in FIG. 3, the example No. P1 has the peak width at half height held within the range of 2 to 5 eV at any of the measuring position. Thus, result of evaluation was good. On the other hand, the comparative examples Nos. P15 and P16 has peak width at half height fall out of the range defined by the invention at some measuring depth. Thus, graining ability and uniformity became no good.

Next, discussion will be given for embodiment of manufacturing method of the aluminum alloy sheet for printing plate.

Embodiment P

At first, aluminum alloy ingots having chemical composition shown in the foregoing example No. P1 were faced to make a thickness of 470 mm. Then, the aluminum alloy ingot was subject homogenization treatment at various temperature shown in the following Table Q-1. Subsequently, hot rolling, cold rolling, intermediate annealing, further cold rolling were performed in order to produce aluminum alloy sheet of 0.3 mm thickness.

Thereafter, with respect to the obtained aluminum alloy sheets, under the same condition, peak width at half height of the examples Nos. P1 to P6 and comparative examples Nos. P7 to P16 were measured. Also, graining ability and uniformity of grained surface were evaluated. The results of evaluation are shown in the following Table Q-1.

TABLE Q-1

| | No | HOMOGENIZATION TREATMENT TEMPERATURE (°C.) | HOT ROLLING START TEMPERATURE (°C.) | PEAK WIDTH AT HALF HEIGHT (eV) 0.025 (μm) | 0.5 (μm) | EVALUATION RESULT GRAINING ABILITY | UNIFORMITY |
|---|---|---|---|---|---|---|---|
| EXAMPLE | Q1 | 525 | 439 | 3.8 | 3.1 | ○ | ○ |
| | Q2 | 594 | 448 | 4.8 | 4.4 | ○ | ○ |
| | Q3 | 543 | 411 | 3.5 | 2.5 | ○ | ○ |
| COMPARATIVE EXAMPLE | Q4 | 488 | 435 | 2.4 | 1.4 | ○ | X |
| | Q5 | 640 | 443 | 5.5 | 4.2 | X | X |
| | Q6 | 515 | 375 | 6.2 | 5.1 | X | X |
| | Q7 | 579 | 473 | 2.5 | 1.7 | ○ | X |

As shown in the foregoing Table Q-1, the examples Nos. Q1 to Q3 were good in graining ability and uniformity evaluation.

On the other hand, the homogenization treatment temperature of the comparative example No. Q4 was less than the lower limit of the range defined by the present invention, and the peak width at half height was less than 2.0 eV, uniformity became no good. The homogenization treatment temperature of the comparative example No. Q5 exceeds the upper limit of the range defined by the present invention, and the peak width at half height exceeds 5.0 eV, graining ability and uniformity were lowered.

The hot rolling start temperature of the comparative example No. Q6 was less than the lower limit of the range defined by the present invention, and the peak width at half height exceeds 5.0 eV, graining ability and uniformity were lowered.

The hot rolling start temperature of the comparative example No. Q7 exceeds the upper limit of the range defined by the present invention, and the peak width at half height is less than 2.0 eV, uniformity was no good.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. An aluminum alloy sheet for printing plate consisting essentially of:

Fe: 0.2 to 0.6 Wt %;

Si: 0.03 to 0.15 Wt %;

Ti: 0.005 to 0.05 Wt %;

Ni: 0.005 to 0.20 Wt %; and balance: Al, wherein said aluminum alloy sheet has good or excellent surface grain uniformity.

2. An aluminum alloy sheet for printing plate consisting essentially of:

Fe: 0.2 to 0.6 Wt %;

Si: 0.03 to 0.15 Wt %;

Ti: 0.005 to 0.05 Wt %;

Ni: 0.005 to 0.20 Wt %; and balance: Al, wherein a ratio of Ni content and Si content satisfies $0.1 \leqq Ni/Si \leqq 3.7$, wherein said aluminum alloy sheet has good or excellent surface grain uniformity, and wherein said aluminum alloy sheet has a peak width at half height between 530 to 536 eV in a range of 2 to 5 eV in a binding energy distribution from a surface to 0.5 μm of depth measured by X-ray photoelectron spectroscopy method.

3. An aluminum alloy sheet as set forth in claim 1, which further contains one or more elements selected from a group consisted of Cu and Zn in a content of 0.005 to 0.05 Wt % per one element.

4. An aluminum alloy sheet as set forth in claim 1, which further contains B in a content of 1 to 50 p.p.m.

5. An aluminum alloy sheet as set forth in claim 1, which further contains an intermetallic compound, the content of said intermetallic compound being in a range of 0.5 to 2.0 Wt %.

6. An aluminum alloy sheet as set forth in claim 1, which further contains an intermetallic compound, said intermetallic compound containing Al and further containing 20 to 30 Wt % of Fe, 0.3 to 0.8 Wt % of Si and 0.3 to 10 Wt % of Ni.

7. An aluminum alloy sheet as set forth in claim 1, which has an aluminum matrix, said aluminum matrix being composed of:

Fe: 0.01 to 0.20 Wt %;

Si: 0.02 to 0.10 Wt %; and

Ni: 0.0005 to 0.020 Wt %.

8. An aluminum alloy sheet as set forth in claim 1, which has a surface layer of 3 μm depth from the surface of the aluminum alloy sheet which is grained by electrolytic graining treatment, said surface layer containing Si in the content of 0.05 to 0.2 Wt %.

9. An aluminum alloy sheet as set forth in claim 1, wherein a surface of said aluminum alloy sheet is grained by electrolytic graining treatment, a polarized resistance of said electrolytic graining treatment being 4 to 17 $\Omega cm^2$.

10. An aluminum alloy sheet as set forth in claim 1, wherein a maximum value of a real number axis component in an impedance trace developed on a Gauss-Argand plane is in a range of 100 to 1000Ω.

11. A manufacturing method of an aluminum alloy sheet for printing plate of claim 1 comprising the steps of:

homogenizing an aluminum alloy ingot, which consists essentially of Fe: 0.2 to 0.6 Wt %, Si: 0.03 to 0.15 Wt %, Ti: 0.005 to 0.05 Wt %, Ni: 0.005 to 0.20 Wt %, and balance: Al and inevitable impurities, a ratio of Ni content and Si content satisfying $0.1 \leqq Ni/Si \leqq 3.7$, at a temperature in a range of 500° to 630° C.;

hot rolling said aluminum ingot at start temperature in a range of 400° to 450° C.;

cold rolling said hot-rolled aluminum sheet;

intermediate annealing said cold-rolled sheet; and final cold rolling said annealed sheet.

12. A manufacturing method of an aluminum alloy sheet as set forth in claim 11, further comprising a step of leveler correcting said rolled sheet after final cold rolling.

13. A manufacturing method of an aluminum alloy sheet as set forth in claim 11, wherein said aluminum alloy ingot contains one or more elements selected from a group consisted of Cu and Zn in a content of 0.005 to 0.05 Wt % per one element.

14. A manufacturing method of an aluminum alloy sheet as set forth in claim 11, wherein obtained aluminum alloy sheet has an intermetallic compound, the content of said intermetallic compound being in a range of 0.5 to 2.0 Wt %.

15. A manufacturing method of an aluminum alloy sheet as set forth in claim 11, wherein obtained aluminum alloy sheet has an intermetallic compound, said intermetallic compound containing Al and further containing 20 to 30 Wt % of Fe, 0.3 to 0.8 Wt % of Si and 0.3 to 10 Wt % of Ni.

16. A manufacturing method of an aluminum alloy sheet as set forth in claim 11, wherein obtained aluminum alloy sheet has an aluminum matrix containing Fe: 0.01 to 0.20 Wt %, Si: 0.02 to 0.10 wt %, and Ni: 0.0005 to 0.020 Wt %.

17. A manufacturing method of an aluminum alloy sheet as set forth in claim 11, further comprising a step of graining a surface of said aluminum alloy sheet by electrolytic graining treatment, the surface layer of 3 μm of depth from the surface containing Si in the content of 0.05 to 0.2 Wt %.

18. A manufacturing method of an aluminum alloy sheet as set forth in claim 11, further comprising a step of graining a surface of said aluminum alloy sheet by electrolytic graining treatment, a polarized resistance upon said electrolytic graining treatment being 4 to 17 $\Omega cm^2$.

19. A manufacturing method of an aluminum alloy sheet as set forth in claim 11, wherein said obtained aluminum alloy sheet has a maximum value of a real number axis component in an impedance trace developed on a Gauss-Argand plane in a range of 100 to 1000Ω.

20. An aluminum alloy sheet as set forth in claim 1, which further contains one or more elements selected from a group consisted of Cu and Zn in a content of 0.005 to 0.05 Wt % per one element.

21. An aluminum alloy sheet as set forth in claim 1, which further contains B in a content of 1 to 50 p.p.m.

22. An aluminum alloy sheet as set forth in claim 1, which further contains an intermetallic compound, the content of said intermetallic compound being in a range of 0.5 to 2.0 Wt %.

23. An aluminum alloy sheet as set forth in claim 1, which further contains an intermetallic compound, said intermetallic compound containing Al and further containing 20 to 30 Wt % of Fe, 0.3 to 0.8 Wt % of Si and 0.3 to 10 Wt % of Ni.

24. A manufacturing method of an aluminum alloy sheet for printing plate of claim 1, comprising the steps of homogenizing an aluminum alloy ingot, which consists essentially of Fe: 0.2 to 0.6 Wt %, Si: 0.03 to 0.15 Wt %, Ti: 0.005 to 0.05 Wt %, Ni: 0.005 to 0.20 Wt %, and balance: Al and impurities, a ratio of Ni content and Si content satisfying $0.1 \leqq Ni/Si \leqq 3.7$, at a temperature in a range of 500° to 630° C.;

hot rolling said aluminum ingot at start temperature in a range of 400° to 450° C.;

cold rolling said hot-rolled aluminum sheet;

intermediate annealing said cold-rolled sheet; and final cold rolling said annealed sheet.

25. A manufacturing method of an aluminum alloy sheet as set forth in claim 24, further comprising a step of leveler correcting said rolled sheet after final cold rolling.

26. A manufacturing method of an aluminum alloy sheet as set forth in claim 24, further comprising a step of graining a surface of said aluminum alloy sheet by electrolytic graining treatment, the surface layer of 3 μm of depth from the surface containing Si in the content of 0.05 to 0.2 Wt %.

27. A manufacturing method of an aluminum alloy sheet as set forth in claim 24, further comprising a step of graining a surface of said aluminum alloy sheet by electrolytic graining treatment, a polarized resistance upon said electrolytic graining treatment being 4 to 17 $\Omega cm^2$.

* * * * *